US008636948B2

(12) United States Patent
Semel et al.

(10) Patent No.: US 8,636,948 B2
(45) Date of Patent: Jan. 28, 2014

(54) METHODS OF PREPARING HIGH DENSITY POWDER METALLURGY PARTS BY IRON BASED INFILTRATION

(75) Inventors: Frederick J. Semel, Riverton, NJ (US); Kalathur S. Narasimhan, Morrestown, NJ (US)

(73) Assignee: Hoeganaes Corporation, Cinnaminson, NJ (US)

( * ) Notice: Subject to any disclaimer, the term of this patent is extended or adjusted under 35 U.S.C. 154(b) by 1460 days.

(21) Appl. No.: 11/004,403

(22) Filed: Dec. 3, 2004

(65) Prior Publication Data

US 2005/0142025 A1 Jun. 30, 2005

Related U.S. Application Data

(60) Provisional application No. 60/526,816, filed on Dec. 3, 2003, provisional application No. 60/619,169, filed on Oct. 15, 2004.

(51) Int. Cl.
*B22F 3/26* (2006.01)

(52) U.S. Cl.
USPC ..... 419/27; 419/2; 419/11; 419/34; 148/514; 148/543

(58) Field of Classification Search
USPC ..... 419/2
See application file for complete search history.

(56) References Cited

U.S. PATENT DOCUMENTS

| | | | | |
|---|---|---|---|---|
| 3,889,349 | A * | 6/1975 | Kaufman | 228/173.2 |
| 4,286,987 | A * | 9/1981 | Matthews | 75/252 |
| 4,834,800 | A | 5/1989 | Semel | 106/403 |
| 5,154,881 | A | 10/1992 | Rutz et al. | 419/37 |
| 5,298,055 | A | 3/1994 | Semel et al. | 75/252 |
| 5,368,630 | A | 11/1994 | Luk | 75/252 |
| 6,602,315 | B2 | 8/2003 | Hendrickson et al. | 75/255 |
| 6,719,948 | B2 | 4/2004 | Lorenz et al. | 419/27 |
| 7,250,134 | B2 | 7/2007 | Kernan et al. | 419/2 |
| 2003/0156963 | A1 | 8/2003 | Lorenz et al. | 419/2 |
| 2005/0109431 | A1 * | 5/2005 | Kernan et al. | 148/514 |

FOREIGN PATENT DOCUMENTS

WO WO 02/094484 A1 11/2002

OTHER PUBLICATIONS

John J. Dunkley, "Atomization," ASM Handbook vol. 7, 1998, pp. 36-52.*
Claus G. Goetzel, "Infiltration," ASM Handbook vol. 7, 1998, pp. 541-564.*

(Continued)

*Primary Examiner* — Roy King
*Assistant Examiner* — Christopher Kessler
(74) *Attorney, Agent, or Firm* — Woodcock Washburn LLP

(57) ABSTRACT

The present invention provides iron-based infiltration methods for manufacturing powder metallurgy components, compositions prepared from those methods, and methods of designing those infiltration methods. Iron-based infiltration methods table include the steps of providing an iron-based infiltrant composed of a near eutectic liquidus composition of a first iron based alloy system and an iron-based base compact composed of a near eutectic solidus powder composition of a second iron based alloy system. The base compact is placed in contact with the infiltrant and heated to a process temperature above the melting point of the infiltrant to form a liquid component of the infiltrant. Lastly, the base compact is infiltrated with the liquid component of the infiltrant. During infiltration, the liquid component of the infiltrant flows into the pores of the base compact.

57 Claims, 9 Drawing Sheets

*Equilibrium Phase Relations In The Fe-C System*

(56) References Cited

OTHER PUBLICATIONS

Banergee, S. et al., "Experimental Study of Capillary-Force Induced Infiltration of Compacted Iron Powders With Cast Iron", *Modern Developments In Powder Metallurgy,* 1984, 16 , 209-244.
Banergee, S.,et al. "Mechanism of Capillary-Force Induced Infiltration of Iron Skeletons with Cast Iron" *International Journal of Powder Metallurgy and Powder Technology,* 1984, 20(4), 325-341.
Davis, J.R., "Cast Irons", *ASM International,* 1996, ASM International, Materials Park, Ohio, 3-15.
Elliot, J.F. et al., "Thermochemistry for Steelmaking", *Thermodynamics and Transport Properties,* 1963, vol. 2, 687-697.
Fang, L-Y., "Casting Characteristics and Mechanical Properties of Low Carbon Equivalent Ductile Iron", *Journal Chinese Foundrymen's Assoc.,* 1997, 23(3), 43-52 (English Language Abstract).
German, R.M., "Special treatments Involving Liquid Phases", *Liquid Phase Sintering,* 1985, Plenum Press, New York, Chapter 7, 157-162.
German, R.M., "*Sintering Theory and Practice*", 1996, John Wiley & Sons, Inc., New York, 111&155.
Mashkov, A.K. et al., "Development of a Process for the Production of Dense Sintered Materials by the Method of Infiltration of Porous Blanks with Low-Melting Point Iron-Boride Alloys", *Soviet Powder Metallurgy and Metal Ceramics,* 1973, 12(1), 32-36.
Mashkov, A.K. et al., "An Experimental Investigation of the Infiltration and Subsequent Heat Treatment of Infiltrated Iron-Base Materials", *Soviet Powder Metallurgy and Metal Ceramics,* 1975, 14(12),993-999.
Mashkov, A.K. et al., "A Boron Containing Material for the Infiltration of Iron Compacts", *Soviet Powder Metallurgy and Metal Ceramics,* 1979, 18(5), 344-346.
Narasimhan, K.S., "Sintering of Powder Mixtures and the Growth of Ferrous Powder Metallurgy", *Material Chemistry and Physics,* 2001, 67, 56-67.
Saritas, S. et al., "Processing and Properties of Ferrous Powder Metallurgy Materials", *Metal Powder Industries Federation,* 2001.
Semel, F.J., "Iron Base Infiltration for High Density", *2004 International Conference on Powder Metallurgy & Particulate Materials,* Jun. 13-17, 2004, Chicago, Illinois, Hoegenaes Corporation, 19 pages.
Semel, F.J., "A New Process for Making High Density Parts" *2004 Powder Metallury World Congress,* Oct. 17-21, Vienna, Austria, 10 pages.

* cited by examiner

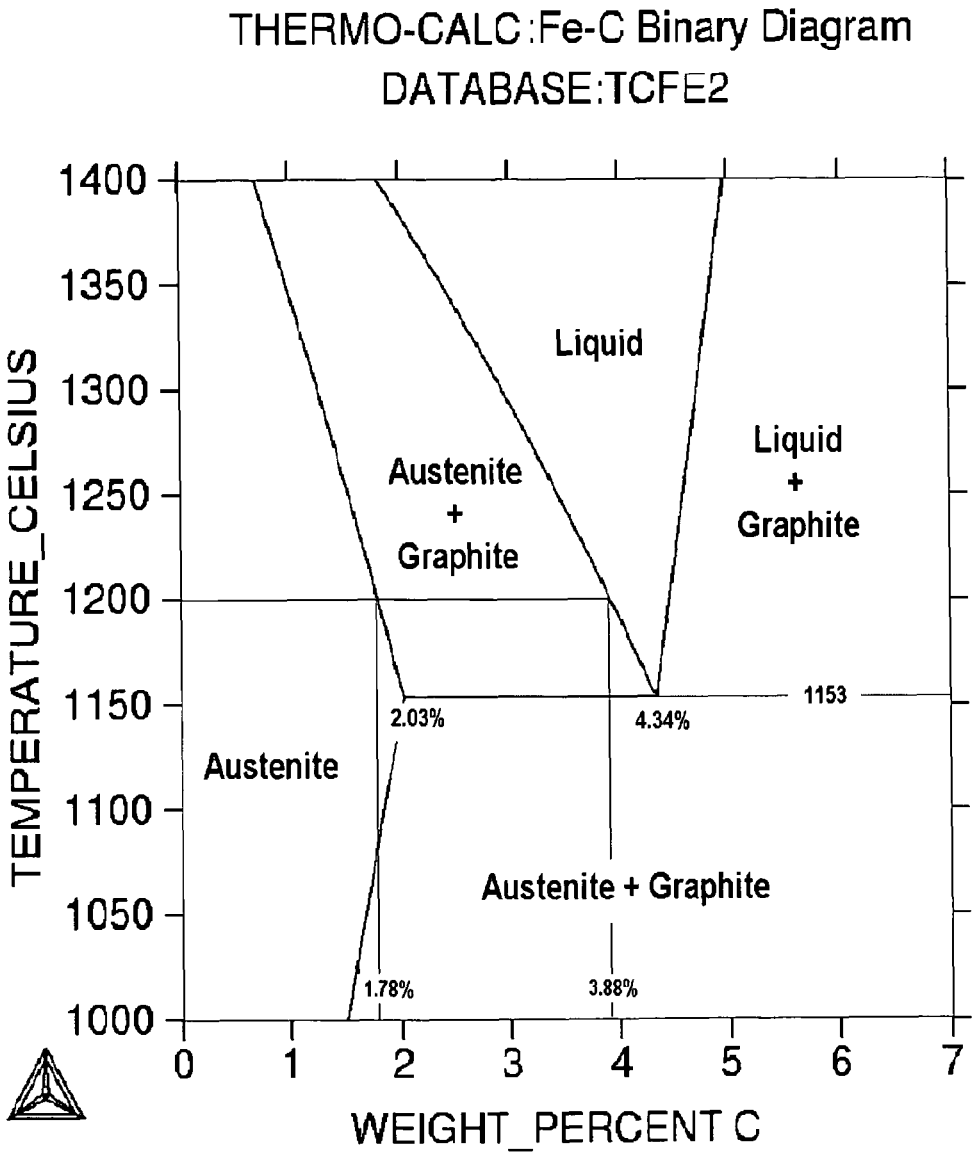
*Figure 1 – Equilibrium Phase Relations In The Fe-C System*

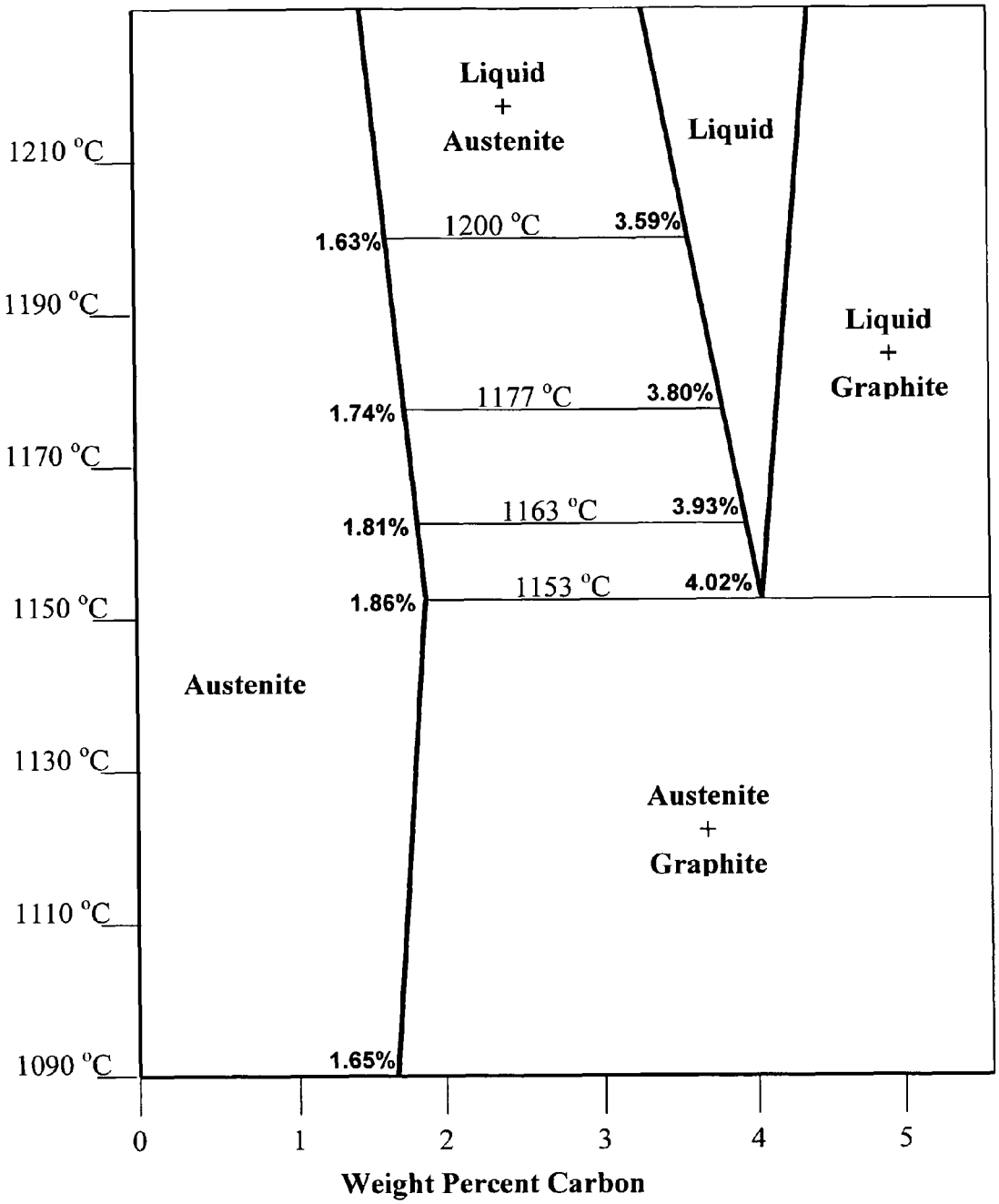
The carbon contents shown on the isotherms in the figure are the Thermo-calc equilibrium values.
Figure 2 – Fe-C-Si Isopleth At 1.0% Silicon

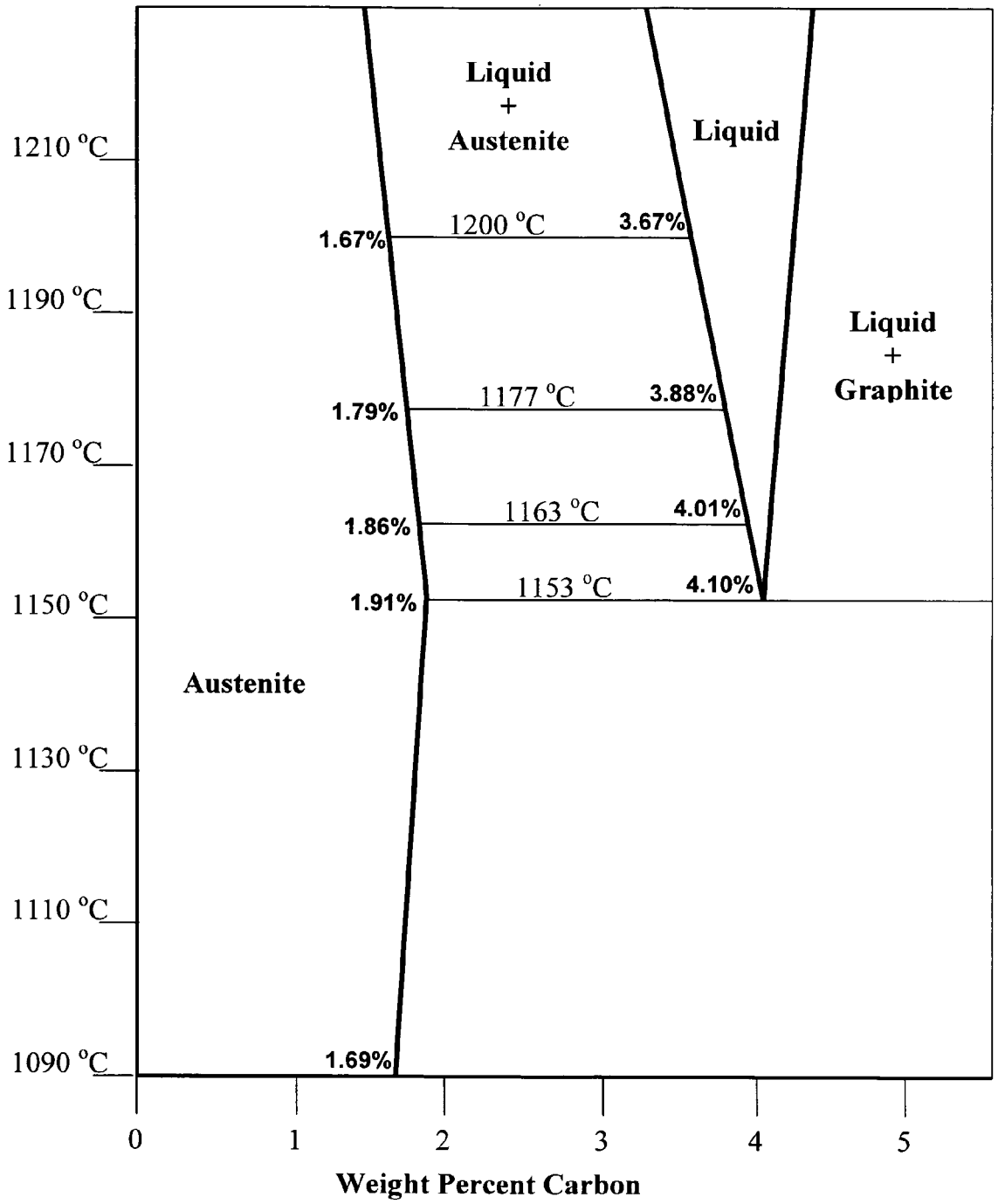
The carbon contents shown on the isotherms in the figure are the Thermo-calc equilibrium values.
Figure 3 – Fe-C-Si Isopleth At 0.75% Silicon

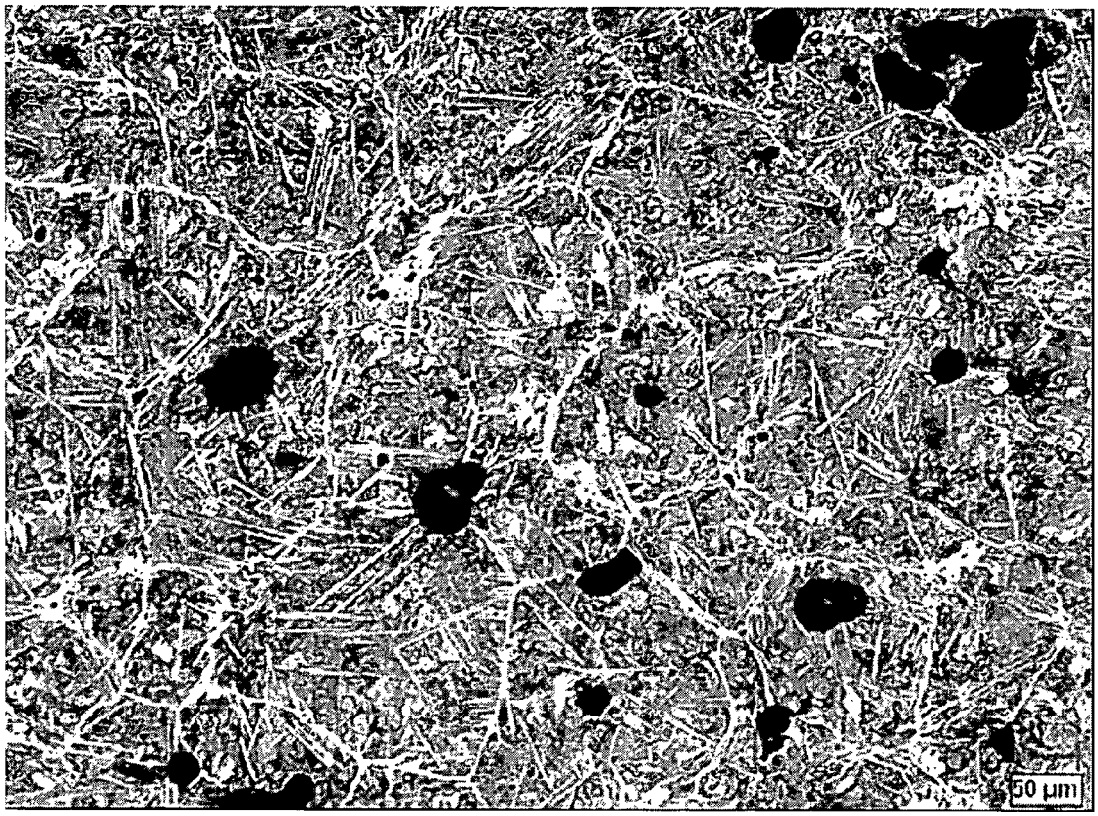
Etchant - 2% Nital -4% Picral @ 200X
*Figure 4 – Infiltrated Fe-C Microstructure*

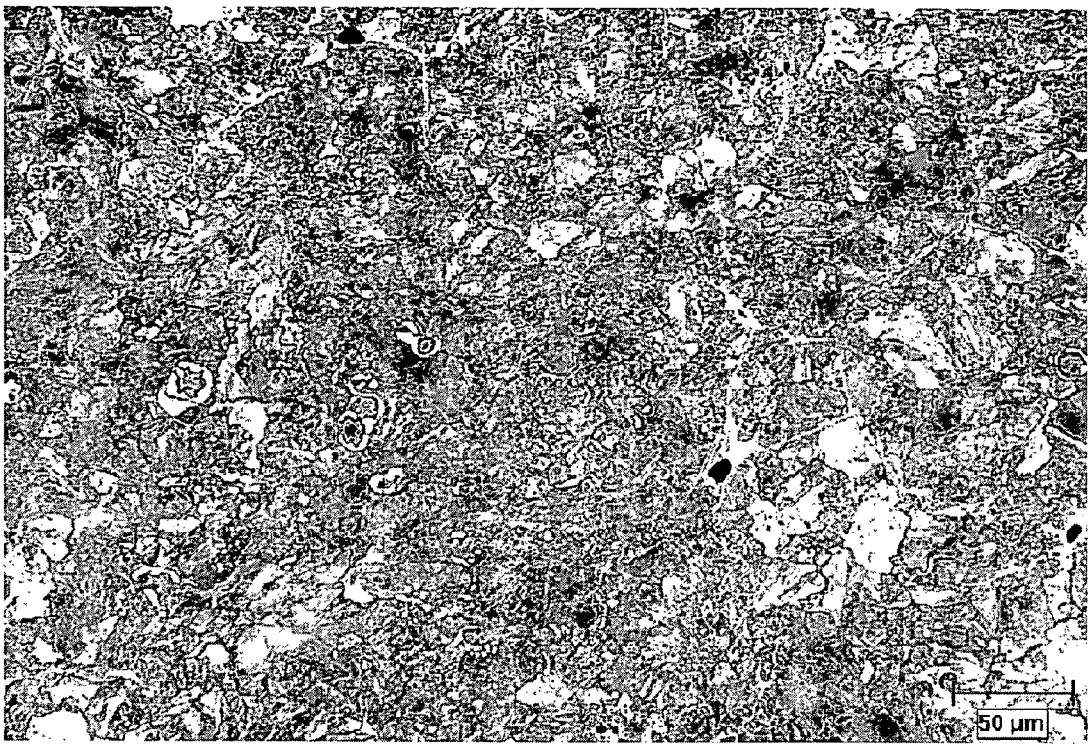
Etchant - 2% Nital -4% Picral @ 300X
*Figure 5 – Infiltrated Fe-C-Si Microstructure At 1% Si*

Micrograph A Etchant – 2% Nital -4% Picral @ 100X

Micrograph B Etchant - 2% Nital -4% Picral @ 100X

*Figure 6 – Silicon Effects On degree Of Graphitization*

Micrograph A Etchant - 2% Nital -4% Picral @ 100X

Micrograph B Etchant - 2% Nital -4% Picral @ 100X

*Figure 7 – Silicon Effects On Degree Of Graphitization*

Micrograph A As-polished @ 100 X

1163 °C, (2125 °F) - Laboratory Batch Furnace

Micrograph B As-polished @ 100 X

1177 °C, (2150 °F) - Laboratory Batch Furnace

Micrograph C As-polished @ 100 X

1163 °C, (2125 °F) – Production Belt Furnace

*Figure 8 – Processing Effects On Graphite Morphology*

Micrograph A As-polished @ 100 X

1177 °C, (2150 °F) - Laboratory Batch Furnace

Micrograph B As-polished @ 100 X

1177 °C, (2150 °F) – Production Belt Furnace

*Figure 9 – Processing Effects On Graphite Morphology*

METHODS OF PREPARING HIGH DENSITY POWDER METALLURGY PARTS BY IRON BASED INFILTRATION

CROSS REFERENCE TO RELATED APPLICATIONS

This application claims priority from U.S. Provisional Application Ser. No. 60/526,816, filed Dec. 3, 2003, and U.S. Provisional Application Ser. No. 60/619,169, filed Oct. 15, 2004, each of which is herein incorporated by reference in its entirety.

FIELD OF THE INVENTION

The present invention relates to iron-based infiltration methods for manufacturing powder metallurgy components, compositions prepared from those methods, and methods of designing those infiltration methods. Specifically, the iron-based infiltration methods of the present invention provide larger powder metallurgy components having higher densities than are possible with traditional powder metallurgy methods.

BACKGROUND OF THE INVENTION

The mechanical properties of ferrous based powder metallurgical components are density limited. In general, the higher the density at any given alloy content, the higher the resultant properties. Consequently, in order to increase mechanical properties without resorting to high alloy content with minimal increase in cost, the major thrust of research in ferrous powder metallurgy in the last quarter century has been to increase density. Traditionally, compaction and sintering techniques have been used to increase density. Of the two, compaction has received the most attention.

In general, densification of a metal powder by compaction involves two different processes. At low pressures, densification occurs as a result of a re-packing process whereby the particles of the powder slide and/or rotate past one another into juxtaposed points of minimal or near minimal spacing. Thereafter, at higher pressures, densification occurs as a result of in situ plastic deformation of individual particles.

The density achieved by conventional compaction techniques depends on the powder composition of interest. Two factors that affect the maximum achievable density of a powder metallurgy composition are lubricant content and the compressive plastic flow properties, or so-called compressibility, of the base powder. Typically, the maximum achievable density increases as the compressibility of the base powder increases.

Lubricants facilitate ejection of compacted parts from a die by lubricating the die wall, lubricants and also assist the re-packing process by lubricating the particles of the powder. The lubricated particles slide and/or rotate past one another with greater ease compared to non-lubricated powders. Lubricants, however, also interfere with densification during the plastic deformation process. In particular, as deformation occurs, the lubricant concomitantly extrudes into and eventually fills the remaining pore spaces within the compact. Whereupon, since the lubricants are typically amorphous materials and essentially behave as an incompressible fluid, the lubricants often prevent further collapse of pore spaces, in effect, impeding densification.

Therefore, the powder metallurgy industry has traditionally sought to increase the compressibility of the base powder and minimize the lubricant content needed to meet the ejection requirements without adversely effecting the powder's ability to densify during the re-packing stage of compaction. For example, U.S. Pat. No. 5,154,881 to Rutz and Luk and U.S. Pat. No. 5,368,630 to Luk describe warm compaction technologies, which permit the use of lower compaction temperatures and lower lubricant contents. Unfortunately, warm compaction processes, like all compaction-based approaches to densification, are limited by the compressibility of the compacted composition.

Another drawback to densifying parts by compaction is that compaction is normally non-isotropic thereby resulting in density gradients within the body of the part. Consequentially, the final dimensions of the part are difficult to control due to shrinkage, which is a function of local density.

Like compaction techniques, sintering processes also densify compacted parts. However, significant densification by sintering is limited by the difficulty of controlling the final dimensions of the part. In addition, it has the practical drawback that it can only be achieved by the use of high sintering temperatures, which require high temperature furnaces that are expensive to purchase and operate.

Double press and sinter processes are another traditional technique for achieving higher densities. For this method, a metal powder is compacted and submitted to a combination lubricant burn-off and inter-critical anneal at a low temperature, for example, in the ferrite to austenite transformation range, (i.e. from about 1355 to about 1670° F.). Thereafter, the compacted part is compacted a second time, and finally sintered at a relatively higher temperature in the austenitic range, (e.g. typically, at about 2050° F. in a production belt furnace). As with other sintering processes, the extra compaction and sintering steps adds significantly to the cost of powder metallurgy parts. Moreover, the maximum achievable density is limited in double press and sinter process due to the natural decrease in compressibility of the compacted part during the second compaction step.

Conventional infiltration techniques are also used to fabricate high density ferrous based parts using a non-ferrous material such as copper or, an alloy of copper. These techniques are limited metallurgically, however, by the use of copper. In addition, use of copper typically adds more to the costs of fabricating powder metallurgy part than conventional double press and sinter techniques.

Therefore, manufacturers continually seek powder metallurgy techniques for preparing compacted parts with desirable mechanical properties and high density at low cost. Hence, methods and compositions that satisfy these requirements are desired.

SUMMARY OF THE INVENTION

The present invention provides iron-based infiltration methods for manufacturing powder metallurgy components, compositions prepared from those methods, and methods of designing those infiltration methods. Iron-based infiltration methods include the steps of providing an iron-based infiltrant composed of a near eutectic liquidus composition of a first iron based alloy system and an iron-based base compact composed of a near eutectic solidus powder composition of a second iron based alloy system. The base compact is placed in contact with the infiltrant and heated to a process temperature above the melting point of the infiltrant to form a liquid component of the infiltrant. Lastly, the base compact is infiltrated with the liquid component of the infiltrant. During infiltration, the liquid component of the infiltrant flows into the pores of the base compact.

The iron-based infiltrant is a compacted iron-based powder mixture comprising a near eutectic liquidus composition of a first iron based alloy system. The iron-based base compact is a porous metal skeleton prepared by compacting an iron-based powder mixture comprising a near eutectic solidus composition of a second iron based alloy system.

The first and second alloy systems are each composed of iron, as a major component, and, as a minor component, carbon, silicon, nickel, copper, molybdenum, manganese, or combinations thereof. In one embodiment the first and second alloy systems are each Fe—C alloys. In another embodiment the first and second alloy systems are each Fe—C—Si alloys. The first and second alloy systems also include conventional lubricants and binders.

In another embodiment, the infiltrant is composed of a near hyper eutectic liquidus composition of a first iron based alloy system and the base compact is composed of a near hypo eutectic solidus powder composition of a second iron based alloy system.

The present invention provides powder metallurgy parts having similar or superior mechanical properties compared to common grades of cast iron, including particularly, the so-called grey, compacted graphite and ductile cast irons.

The methods are useful for producing powder metallurgy parts on any scale of production. For example the methods are used to produce powder metallurgy parts on a small scale, such as for example, a run of less than about 300 parts, as well as large scale production runs of, for example, more than 10,000 parts.

DESCRIPTION OF THE FIGURES

FIG. 1 is an equilibrium phase diagram for the binary Fe—C alloy system

FIG. 2 is an equilibrium phase diagram for the ternary Fe—C—Si alloy system having a binary isopleth at 1.0% Si.

FIG. 3 is an equilibrium phase diagram for the ternary Fe—C—Si alloy system having a binary isopleth at 0.75 weight percent silicon.

FIG. 4 is a micrograph of a typical infiltrated part composed of an Fe—C alloy.

FIG. 5 is a micrograph of an infiltrated part composed of an Fe—C—Si alloy composed of about 1.0 weight percent silicon.

DETAILED DESCRIPTION OF THE ILLUSTRATIVE EMBODIMENTS

Figure 6A:
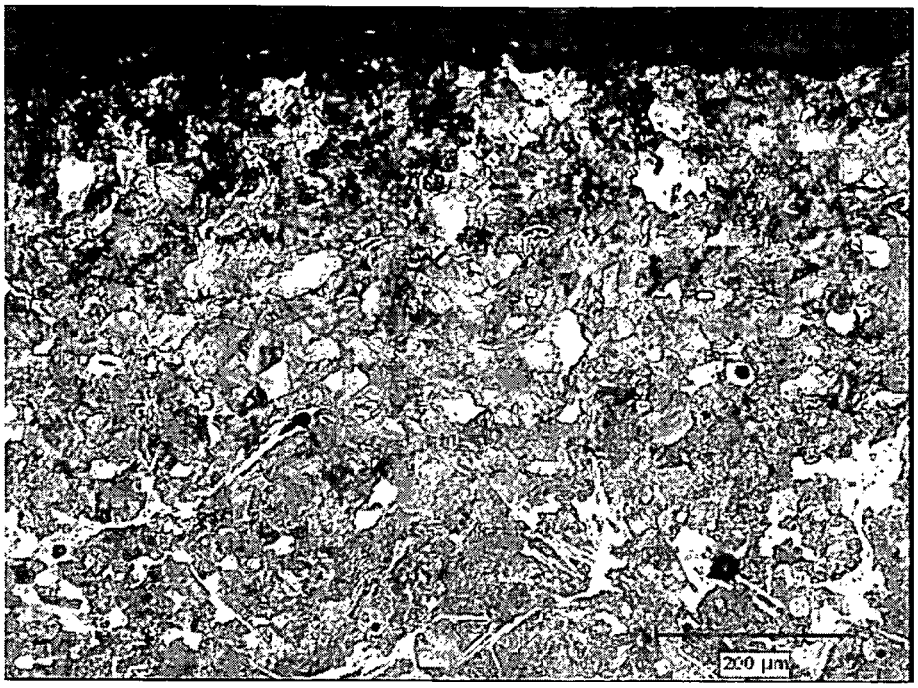
FIG. 6A is a micrograph of an infiltrated part composed of an Fe—C—Si alloy showing a degree of graphitization.

The present invention provides iron-based infiltration methods for manufacturing powder metallurgy components, compositions prepared according to those methods, and methods of designing those infiltration methods. Iron based infiltration methods include the steps of providing an infiltrant composed of a eutectic liquidus composition or a near eutectic liquidus composition of a first iron based alloy system; and providing a porous skeleton, (hereafter, called a base compact), composed of a eutectic solidus composition or a near eutectic solidus composition of a second iron based alloy system. The base compact is placed in contact with the infiltrant and both are heated to a process temperature above the melting point of the infiltrant to form a liquid component of the infiltrant. Lastly, the base compact is infiltrated with the liquid component of the infiltrant. During infiltration, the liquid component of the infiltrant flows into the pores of the base compact. Capillary forces are the primary driving force for infiltrating the base compact.

Methods of designing iron-based infiltration techniques concern selecting the alloy system of the infiltrated part, i.e., elements in the base compact and the infiltrant, the equilibrium phase relations of the alloy system, the base compact density, the infiltrant weight, and process conditions, including, for example, process temperature, process time, and furnace atmosphere.

The iron-based infiltrant is a compacted iron-based powder component. The compacted iron based powder component is prepared by compacting an iron based powder composition using conventional compacting techniques known to those skilled in the art. The iron-based powder composition is a eutectic or near eutectic liquidus composition of the first iron based alloy system. The infiltrant is compacted using conventional compaction techniques known to those skilled in the powder metallurgy industry. "Near eutectic liquidus" composition means a composition having a carbon concentration within a concentration range close to the eutectic liquidus carbon concentration of an iron-alloy composition. The range of carbon concentration, for a stated iron-alloy eutectic composition, is from about 0.1 weight percent below the eutectic carbon concentration to about 0.3 weight percent above the eutectic carbon concentration. Thus, near eutectic liquidus compositions include hyper-eutectic and hypo eutectic liquidus compositions. As used herein, eutectic liquidus composition means a composition of an alloy system having the same ratio of elements as the liquidus composition present during a eutectic reaction. The infiltrant powder composition includes conventional lubricants and binders. The green compact or sintered.

The iron-based base compact, or porous metal skeleton, is a compacted iron-based powder component. The compacted iron based powder component is prepared by compacting an iron-based powder composition using conventional compaction techniques known to those skilled in the art. The iron based powder composition comprising a eutectic or near eutectic solidus composition of a second iron based alloy system. Near eutectic solidus composition means a composition having a carbon concentration within a concentration range close to the eutectic solidus carbon concentration of an iron-alloy composition. The range of carbon concentration, for a stated iron-alloy eutectic composition, is from about 0.3 weight percent below the eutectic carbon concentration to about 0.1 weight percent above the eutectic carbon concentration. Thus, near eutectic solidus compositions include hyper-eutectic and hypo eutectic liquidus compositions. A eutectic solidus composition means the composition of an alloy system having the same ratio of elements as the solidus composition during a eutectic reaction. The base compact powder composition includes conventional lubricants and binders.

Infiltration techniques utilizing a base compact and an infiltrant are commonly known to those skilled in that art. For example, U.S. Pat. No. 6,719,948, B2 to Lorenz et. al., which is herein incorporated by reference in its entirety, describes techniques for infiltration of a powder metal skeleton by a similar alloy with melting point depressed.

Selecting the alloy system of the finished infiltrated part provides composition parameters for the infiltrant and base compact compositions. Although reference to phase relation diagrams may appear to present any number of compositions to choose from when selecting the infiltrant and base compact compositions, the actual choice of compositions capable of providing favorable infiltration conditions is limited.

The first and second alloy systems include binary, ternary, and higher iron-based alloy systems known to those skilled in the art. Although the base compact and/or the infiltrant are composed of only two elements when utilizing binary alloy systems, the iron-based infiltration method design principles governing binary alloy systems apply to higher order alloy systems where the infiltrant and/or the base compact include more than two elements.

The first and second alloy systems are each composed of iron, as a major component, and, as a minor component, carbon, silicon, nickel, copper, molybdenum, manganese, or combinations thereof. The minor components may be in the elemental or pre-alloyed form with iron or with one or another of the other minor alloy ingredients. The minor components in the first alloy system may be the same as, or different from, the minor components in the second alloy composition. A preferred alloyed system is the Fe—C alloy system, such as for example, the steel and/or cast iron systems. A more preferred alloy system is the Fe—C—Si alloy system.

The first and second alloy systems typically have temperature ranges over which they melt, not a single melting temperature. A binary alloy system, such as for example Fe—C, begins to melt at the eutectic temperature and becomes fully molten at the liquidus temperature. An equilibrium phase diagram for the Fe—C alloy system is shown in FIG. 1. Referring to FIG. 1, the infiltration temperature can theoretically be chosen anywhere between the eutectic temperature (1153° C.) and the temperature which the diagram indicates corresponds to a liquid phase content in the infiltrated part of no greater than about 25%. For the compositions of interest, the infiltration temperature is typically less than about 1210° C.

Preferably, the base compact iron based powder composition and infiltrant iron based powder composition are each substantially homogeneous, binder-treated compositions. Gross variations due to segregation are greatly reduced, by binder treatment which also prevents significant carbon losses due to dusting. In addition, extra carbon may be added to the infiltrant and base compact compositions to offset the losses due to carbon reduction of the residual oxides of the respective base powders. Another method of compensating for extraneous decarburization and carbon dusting losses during processing is to provide additional graphite to the infiltrant powder composition. The latter is typically dependent on the particular processing equipment that is used to implement the process and is consequently determined empirically by methods known to those skilled in the art such, as for example, by trial and error.

Conventional binders and binder treatment methods known to those skilled in the art are used to prepare the infiltrant and base compact powder compositions. Conventional methods include, for example, the binders and binder treatment methods described in U.S. Pat. No. 4,834,800 to Semel, U.S. Pat. No. 5,298,055 to Semel and Luk, and U.S. Pat. No. 6,602,315 to Luk. Preferably, the binders and methods described in U.S. Pat. No. 5,298,055 are used to prepare base compact compositions. Preferably, the binders and methods of U.S. Pat. No. 4,834,800 or U.S. Pat. No. 5,298,055 are used to prepare the Infiltrant compositions.

Substantial graphite segregation in the infiltrant causes uneven and incomplete melting which leads to localized erosion of the infiltrated surface and in some cases incomplete infiltration. Substantial graphite segregation in the base compact typically causes random defects due to local melting on un-infiltrated surfaces and contributes to localized erosion of the infiltrated surface as well. As with substantial graphite segregation in the infiltrant, carbon losses in the base compact cause incomplete infiltration in some cases.

Once the alloy system is selected, the equilibrium phase relations of the alloy system can be calculated using techniques known to those skilled in the art. Equilibrium phase relations of an alloy system specify the infiltrant and base compact compositions and the melting points of each composition. Preferably, equilibrium phase relations are calculated by Thermo-Calc, a commercially available computational thermodynamics program used to perform calculations of thermodynamic properties of multi-component alloy systems based on the Kaufman binary thermodynamic database. Unless stated otherwise, all subsequent phase diagrams and equilibrium phase relations were generated using Thermo-Calc.

Once the equilibrium phase relations of the first alloy system are known, the infiltrant composition is selected. The infiltrant composition for a given alloy system is near or equal to the eutectic liquidus composition in order to facilitate substantially complete infiltration. When composed of a eutectic or near eutectic liquidus composition, upon attaining a process temperature near, or at, the eutectic temperature, the infiltrant melts completely and infiltrates the base compact.

If the infiltrant is not composed of a eutectic or near eutectic liquidus composition the infiltrant will not completely melt at, or near, the eutectic temperature thereby leaving un-infiltrated material on the surface of an infiltrated part. For example, referring to FIG. 1, the infiltrant will first start to melt at the eutectic temperature, i.e. at about 1153° C., dividing as it does into a liquid component, i.e., liquid phase, and a solid component, i.e., solid phase, of the eutectic liquidus and solidus carbon contents. Based on the lever rule and the compositional values indicated in FIG. 1, the residual solid phase at this point will constitute about 20% by weight of the original infiltrant. As the liquid component of the infiltrant forms, it infiltrates the base compact thereby leaving the solid component of the infiltrant behind. The solid component of the infiltrant will not melt at the initial process temperature, e.g., 1225° C. due to the low carbon content of the solid component. In fact, according to the phase relations indicated in FIG. 1, it melts over a range of temperatures with its final melting point being about 1400° C. Thus, if not at a eutectic or near eutectic liquidus composition the process temperature must increase substantially during the heating and infiltration steps to melt the solid infiltrant component.

The infiltrant composition need not be an equilibrium, or near equilibrium, composition vis a vis the base compact. Indeed, the infiltrant composition does not have to be of the same alloy system as the base compact. For example, an infiltrant composition in the Fe—C—Ni—Mo system can be used with base compact compositions in the Fe—C—Si alloy system.

Selecting an infiltrant composition is more difficult than selecting a base compact composition because the infiltrant substantially disappears during the course of the infiltration process and in part, because its performance is dependent on several properties that act in concert with one another. It is known in the art that the liquid phase properties of the Infiltrant, the contact angle and the interfacial energy versus the vapor phase, affect the capillarity of the infiltrant alloy system. Another liquid phase property, viscosity, also acts to influence the infiltration rate. As a consequence of the number and complexity of these properties, the preferred infiltrant compositions were selected based on the measurable outcome of the process including, ease of infiltration, appearance of the infiltrated surface, and final infiltrated density.

Particle size, alloy uniformity, and alloy homogeneity of the powders used to prepare the infiltrant affect mechanical properties. The particle size of powders used in making the infiltrant affect the rate at which the infiltrant melts and the infiltrant's performance. Typically, large particles melt slower than small particles and generally lead to large residual tabs of un-infiltrated material after processing. Therefore, the infiltrant is prepared by employing small particle size powders. Preferably, the iron base powder used to prepare the infiltrant is less than about 45 micrometers as derived from a minus 325 mesh cut of the corresponding molding grade of powder, typically 60 mesh or less (equivalent to 250 micrometers or less). Preferably, the average particle size of the admixed alloy powders is less that about 20 micrometers, and more preferably less than about 10 micrometers. In one embodiment, the average particle size of the graphite powder is less than 10 micrometers.

In some embodiments, where the process temperature is selected at about 10° C., (18° F.) above the eutectic temperature, larger particle sizes are utilized to prepare infiltrant compacts. Normally the process temperature is selected to be about 35° C., (~60° F.) above the eutectic temperature, in order to control the dimensional change of the process by liquid phase sintering after infiltration. However, it is possible to accommodate the use of infiltrants made with larger particles and control the dimensional change by using a two step method involving infiltration at the lower temperature and liquid phase sintering at the higher one.

Alloy homogeneity of the infiltrant as it approaches the eutectic temperature affects infiltration. Homogeneity depends on the extent to which the alloy components commingle, i.e., dissolve and/or disperse, with the iron component of the infiltrant before and/or during melting. Alloys that don't dissolve form un-infiltrated residue. Undissolved alloys also either increase or decrease the carbon units that are needed to produce a eutectic reaction, i.e. to melt the infiltrant. The specific effect is determined in accordance with the phase relations that the alloy has with iron and carbon. If the undissolved alloy increases the carbon needed for a eutectic reaction, there will not be enough carbon to react with the available iron, and the resultant un-reacted iron will become uninfiltrated residue. If the undissolved alloy decreases the carbon needed for a eutectic reaction, there will be too much carbon to react with iron and the excess carbon will react with the iron in the infiltrated surface or, in effect, erode the surface.

Alloys are admixed with iron in three different forms: as an elemental powder, as a component of a pre-alloyed powder, or as a component of a compound. Preferably, the alloy is added as an iron base pre-alloy to facilitate homogeneity.

In one embodiment, the infiltrant is composed of a minus 325 mesh cut of a standard 60 mesh by down molding grade powder of an atomized iron base pre-alloy nominally containing 0.5% molybdenum, 1.8% nickel and 0.15% manganese by weight, which is commercially available as Hoeganaes Corporation's product Ancorsteel 4600 V. Carbon is admixed in the form of a commercially pure grade of graphite. According to Thermo-calc calculations, the eutectic carbon content in this case is about 4.28% by weight. Preferably, to allow for carbon losses in processing in advance of infiltration, the infiltrant composition is a near hyper-eutectic having a carbon content of about 4.43%. Preferably, sufficient extra carbon is also added to the composition to offset the expected carbon losses due to the oxygen units present in the iron base pre-alloy, (e.g. typically, ~0.06 to 0.10% C). The composition is blended with a 0.1% by weight addition of zinc stearate as a lubricant and binder treated in accordance commonly known powder metallurgy techniques.

In another embodiment, the infiltrant is composed of a minus 325 mesh cut of a standard 60 mesh by down molding grade powder of an atomized iron that is made with low residual impurities, such as for example, Hoeganaes Corporations product Ancorsteel 1000 B. Silicon in an amount between 0.15 to 0.25% by weight, typically ~0.17%, is added to this composition in the form of an atomized ferrosilicon powder nominally containing 20% silicon by weight and having an average particle size under 20 micrometers. Carbon is admixed in the form of a commercially pure grade of graphite. According to Thermo-calc, the eutectic carbon content of the resulting iron-silicon alloy is about 4.29% by weight. Preferably, to allow for carbon losses in processing in advance of infiltration, the composition is a near hyper-eutectic having a carbon content of about 4.44% plus sufficient extra carbon to offset the expected losses due to the oxygen units present in the iron base powders, (e.g. again, ~0.06 to 0.10% C). The composition is blended with a 0.1% by weight addition of zinc stearate as a lubricant and binder treated in accordance commonly known powder metallurgy techniques.

Once the equilibrium phase relations of the second alloy system are known, the base compact composition is selected. The base compact composition is a function of the eutectic solidus composition of the second alloy system. Selecting a base compact composition that is not a near eutectic solidus or eutectic solidus composition may cause diffusional solidification, which decreases the infiltration rate and, in some cases, impedes the infiltration process altogether.

Diffusional solidification is the result of a concentration differential between the base compact composition and the equilibrium solidus composition of the second alloy system. During infiltration, as the liquid component of the infiltrant, i.e., a eutectic liquidus composition, enters the pore structure of the base compact, the base compact and infiltrant begin to equilibrate by diffusionally transferring carbon from the infiltrant to the base compact. The transfer of carbon will be accompanied by a partial freezing of the liquid component of the infiltrant along the plane of the liquid component front as the liquid component advances into the base compact. The partial freezing of the liquid component of the infiltrant is caused by a decrease in carbon concentration below the liquid phase concentration limit. The extent to which the liquid solidifies will depend on the magnitude of the carbon differences involved.

For example, referring to FIG. 1, assuming an iron-based base compact has a composition defined as the solidus value at 1200° C., the solidus carbon content is lower than the carbon content needed for equilibrium with liquids at all lower temperatures including, in particular, that of the solidus composition at the eutectic temperature. Consequently, the liquid component of an infiltrant, which has a eutectic liquidus composition, will diffusionally solidify as carbon diffuses from the infiltrant to the base compact. The infiltration process will either stop completely or will be slowed so as to significantly extend the time necessary to complete infiltration.

As shown by the phase relations of the second alloy system, the threat of diffusional solidification can be averted by (1) selecting a base compact composition that reduces the concentration differential between the base compact and the eutectic solidus value, and if necessary, (2) increasing the process temperature to re-melt any liquid component of the infiltrant that solidifies during infiltration. The required increase in process temperature is determined by reference to the phase relations of the base compact alloy system.

Preferably, in the Fe—C alloy system, the base compact composition is selected so that that carbon concentration differential between the base compact and the eutectic solidus value is about 0.3 weight percent or less. More preferably, the base compact composition is selected so that that carbon concentration differential between the base compact and the eutectic solidus value is about 0.15 weight percent or less.

The rate of heating to a process temperature affects the potential for diffusional solidification. Rapid heating, such as for example the heating rate of conventional batch furnaces, permits larger carbon concentration differentials, e.g., up to about 0.3 weight percent, without substantial diffusional solidification. Slow heating rates, such as for example the heating rate of conventional production belt furnaces, permit lower carbon concentration differentials, e.g., up to about 0.15 weight percent, without substantial diffusional solidification.

Preferably, when selecting the Fe—C alloy system, the infiltrant composition prior to infiltration, comprises from 4.24 to 4.64 weight percent carbon and the base compact composition, prior to infiltration, comprises from about 1.75 to about 2.15 weight percent carbon.

In another embodiment, wherein the infiltrant composition is composed of a near hyper eutectic liquidus composition and the base compact is composed of a near hypo eutectic solidus powder composition, the infiltrant composition, prior to infiltration, is composed of from about 4.34 to about 4.59 weight percent carbon and the base compact composition, prior to infiltration, comprises from about 1.75 to about 2.03 weight percent carbon. Preferably, the infiltrant composition, prior to infiltration, is composed of from about 4.34 to about 4.49 weight percent carbon and the base compact composition, prior to infiltration, comprises from about 1.88 to about 2.03 weight percent carbon.

In one embodiment, the base compact contains minor alloy components not found in the infiltrant. The minor alloy components not found in the infiltrant provide mechanical properties to the base compact that are imparted to the infiltrated part. Preferably, the base compact comprises from about 0.01 to about 1.0 weight percent manganese, from about 0.01 to about 1.5 weight percent molybdenum, from about 0.01 to about 4.0 weight percent copper, from about 0.01 to about 4.0 weight percent nickel, or combinations thereof. More preferably, the base compact comprises from about 0.25 to about 0.8 weight percent manganese, from about 0.5 to about 1.5 weight percent molybdenum, from about 0.5 to about 2.0 weight percent copper, from about 0.51 to about 2.0 weight percent nickel, or combinations thereof.

Once the infiltrant composition and base compact composition are selected, the base compact density and weight, and infiltrant weight are selected. The base compact density and weight determine the volume of pores present in the base compact. The density also determines the open, or interconnected, porosity, which is a measure of the fraction of the pores that are accessible to the surface of the compact. In general, open porosity is a decreasing function of density, however, the function is non-linear and the greatest rate of decrease in porosity occurs at high densities, typically in excess of 90% of the theoretical maximum density, i.e., pore free density. Thus, preferably, the density of the base compact about 90% of the pore free value or less.

For example, in Fe—C alloy systems, pore free density decreases as the carbon content increases. Assuming a base compact carbon content of about 2%, the pore free density of the base compact would be about 7.49 g/cm$^3$. Thus, the base compact density would be about 6.8 g/cm$^3$ or less. The equilibrium phase relations of other alloy systems indicated substantially similar values.

Preferably, the base compact density used with compositions based on relatively high compressibility atomized iron or iron base pre-alloyed powders is about 6.7 g/cm$^3$ or less. Lower densities provide more latitude in selecting the carbon content of the base compact composition and/or in the magnitude of the acceptable carbon losses due to dusting and/or oxidation during processing.

Preferably, base compacts composed of relatively low compressibility sponge iron powders or low compressibility iron base pre-alloys is about 6.4 g/cm$^3$ or less so as to lower the compaction pressure needed to make a base compact and thereby free more press capacity to make larger parts.

Selection of the infiltrant weight provides a means of control of the density of the final infiltrated part. The infiltrant weight to achieve maximum theoretical density of infiltration, i.e., hereinafter "full density," is the product of the density of the infiltrant and the pore volume of the base compact at an infiltration temperature. Although the infiltrant density can be estimated with reasonable accuracy, the pore volume parameter needed to calculate the full density of infiltration is not easily estimated. The pore volume of the base compact is subject to unpredictable volume changes due admix carbon solution and to densification by solid state sintering during heating in advance of infiltration.

The infiltrant weight to full density for the Fe—C alloy system for varying base compact densities is shown in Table 1 below.

TABLE 1

Approximate Infiltrant Weight To Full Density

| Base Compact Density (g/cm$^3$) | Infiltrant Weight as a Percentage of the Base Compact Weight | Infiltrant Weight as a Percentage of the Final Infiltrated Weight |
|---|---|---|
| 6.3 | 21.3 | 17.5 |
| 6.4 | 19.5 | 16.3 |
| 6.5 | 17.7 | 15.1 |
| 6.6 | 16.0 | 13.8 |
| 6.7 | 14.3 | 12.5 |
| 6.8 | 12.7 | 11.3 |

Infiltrant weights calculated on the basis of the indicated "Infiltrant Weight as a Percentage of the Base Compact Weight" values in Table 1 have been found to be within about ±5% of the actual full weight values. These data have also been found to be generally applicable without modification to infiltration in both the ternary Fe—C—Si alloy system and higher alloy systems.

The "Infiltrant Weight as a Percentage of the Final Infiltrated Weight" values of Table 1 indicate the content of the liquid component of the infiltrated part at the eutectic temperature. Preferably, the percentage of liquid component of the infiltrant is higher than stated in Table 1 because the process temperature is preferably selected to be higher than the eutectic temperature. Thus, assuming the full density weight of the infiltrant is used, the values in Table 1 are minimum liquid phase content of the infiltrated part at the eutectic temperature.

Because the percentage of liquid component of the infiltrant increases as the base compact density increases, the liquid phase content provides a minimum base compact density. Extrapolation of the data found in the middle column of Table 1 indicates a minimum base compact density of about 5.57 g/cm$^3$ corresponding to a preferred maximum liquid phase content after infiltration of about 25%.

Once the base compact density and weight, and infiltrant weight are selected, the process conditions, including process temperature, time at temperature and furnace atmosphere are selected.

Process temperatures are selected by referring to a phase relations diagram, and determining the temperature corresponding to the solidus carbon content value of the base compact. This temperature ensures that the infiltrant that solidifies due to diffusional solidification during heating to the process temperature, if any, will re-melt. Higher process temperatures, may be used, provided the liquid phase content does not exceed the preferred maximum liquid phase content of 25 weight percent. Substantial liquid phase formation causes microstructural coarsening, which is detrimental to mechanical properties or, in a worse case scenario, leads to slumping, or other undesirable shape changes.

In the Fe—C alloy system, the maximum process temperatures determined by these criteria are calculated from the average carbon content of the infiltrated part. For example, the final infiltrated carbon content typically range from about 2.15 to about 2.35 weight percent. By applying the lever rule to the Fe—C phase relations diagram shown in FIG. 1, the process temperatures corresponding to a preferred maximum liquid phase content of 25% would be about 1230° C., (2245° F.), at the lower carbon value (2.15 wt. %) and about 1200° C., (2192° F.), at the higher carbon value (2.35 wt. %). However, process temperatures are typically at least about 25° C., (45° F.) lower than these process temperatures due to other considerations. Typical process temperatures are from about 1163° F., (2125° F.) to about 1177° C., (2150° F.).

As an alternative, the process temperature can be selected based on the "infiltrant weight to full density" as calculated in Table 1. Selecting an infiltrant weight that is about 90 to about 95% of the "infiltrant weight to full density" ensures there is not an excess of infiltrant. However, this method of selecting a process temperature results in an infiltrated part with residual porosity. The residual porositiy can be reduced or eliminated by selecting a process temperature which provides for liquid phase sintering after infiltration. Typically, liquid phase sintering requires a liquid phase content of 15% or higher.

For example, referring to FIG. 1, consider infiltrating a base compact having a density of about 6.7 g/cm$^3$ and a near hypo-solidus eutectic carbon content in the Fe—C system of about 1.93% with an infiltrant of the eutectic carbon content, (i.e. about 4.34%), that is otherwise at about 90% of the full weight value as indicated in the earlier Table 1. Based on this data, the average carbon content of the infiltrated compact is determined according to $$\text{Ave. Carbon}=2.20\%\ [1.93+(0.9)(0.143)(4.34)]/[1+(0.9)(0.143)]$$

Based on the Fe—C equilibrium phase relations of FIG. 1, and assuming a liquid phase content of 15%, the process temperature is at least about 1185° C. Increasing, or decreasing, the process temperature by about 5° C. increases, or decreases, the liquid phase content by about 1%.

The time at process temperature is selected to achieve complete infiltration and provide for the reduction or elimination by liquid phase sintering, any residual porosity that may exist after infiltration. The pore space of the base compact may be filled in part, or it may be substantially, or completely, filled in the infiltration step.

Usually, the time at process temperature is from about 15 to about 30 minutes. Times at temperature seldom exceed 30 minutes but on occasion have been as long as 60 minutes, or more, or as short as 15 or 20 minutes. Preferably, the base compact and infiltrant are heated slowly to provide a uniform temperature throughout the base compact.

In one embodiment, after infiltration, the base compact may undergo liquid phase sintering that consolidates the early sinter bonds of the base compact and reduces residual porosity. Prolonged liquid phase sintering, however, causes undesirable microstructural coarsening.

Furnace atmospheres include those commonly used in powder metallurgy laboratory batch furnaces and production belt furnaces. Furnace atmospheres include hydrogen or synthetic dissociated ammonia atmospheres, (i.e. 75% $H_2$ and 25% $N_2$ by volume), as well as a nitrogen based atmospheres, (i.e. 90% $N_2$ and 10% $H_2$ by volume). Preferably, the furnace atmosphere is a nitrogen based atmosphere, which is more economical.

In addition to selecting the furnace atmosphere base chemistry, efforts are made to control the furnace atmosphere dew point and carbon potential to reduce or prevent decarburization, which may impede infiltration. In order to prevent decarburization, the carbon potential in the furnace is preferably similar to the carbon potential of graphite. Until the infiltrant and base compact attain the eutectic temperature, much of the carbon they contain is present as graphite. Controlling the dew point and the amount of hydrogen in the furnace atmosphere will not prevent the decarburization of graphite by water vapor or oxygen that may be found in the furnace atmosphere.

Graphite oxidation is prevented or reduced by increasing the carbon potential of the furnace atmosphere by introducing a carbon containing compound, such as a hydrocarbon into the furnace atmosphere. Any hydrocarbons commonly utilized by the powder metallurgy industry may be introduced into the furnace atmosphere, such as for example, methane. Methane decomposes at high temperature and is more susceptible to oxidation than graphite. The amount of methane introduced into the furnace atmosphere depends on the oxygen purity of the base atmosphere and the 'oxygen tightness' of the furnace. Typically, methane additions are about 1.0% or less of the volume of the base furnace atmosphere. Another method to prevent graphite oxidation is to enclose the parts in a graphite gettered box, such as for example, a ceramic sintering tray with a close fitting cover.

A means of judging the efficacy of the methods of iron base infiltration is to compare the density of an infiltrated part to the theoretical maximum density of the part. The theoretical maximum, or pore free density, of the Fe—C alloy system is dependent on (1) carbon content, (2) the microstructural constituents which the carbon precipitates, and (3) the density and content of the Fe phase, which composes the balance of the microstructure. Assuming the carbon containing precipitate is cementite, (i.e. $Fe_3C$), which is typically the case in powder metallurgy, then the pore free density, $\rho_{Fe—C}$, is calculated as a function of the carbon content, % C, as follows:

$$1/\rho_{Fe—C}=1/\rho_{Fe}+0.1495\%\ C[1/\rho_{cementite}-1/\rho_{Fe}]. \quad 1)$$

where $\rho_{Fe}$ and $\rho_{cementite}$ are the pore free densities of the constituent phases, (i.e. 7.86 and 7.40 g/cm$^3$ respectively), and 0.1495 is 1/100 the quotient of the molecular weights of the $Fe_3C$ and C, (i.e. 179.56 and 12.01 respectively).

The pore free density of Fe—C alloys composed of from about 2.15 to about 2.35 weight percent carbon are shown in Table 2:

TABLE 2

Pore Free Densities of Alloys of Interest in the Binary Fe—C System

| Carbon Content (wt. %) | Pore Free Density (g/cm$^3$) |
|---|---|
| 2.15 | 7.71 |
| 2.25 | 7.70 |
| 2.35 | 7.69 |

As shown in Table 2, the pore free density of an Fe—C alloy is relatively insensitive to the carbon content in the indicated range. Thus, densities of infiltrated compacts in the Fe—C system with carbon contents in the range from about 2.15 to about 2.35%, generally approached the theoretical maximum or pore free value to within about 1 or about 2%.

Similar to the binary Fe—C alloy system, the eutectic composition in many ternary and higher alloy systems is composed of three phases in equilibrium. Thus, although the equilibrium phase relations are generally more complicated in many ternary and higher alloy systems, the same infiltration process design considerations are applicable. Alloy additions to the Fe—C alloy system provide infiltrated parts having beneficial mechanical properties by modifying the infiltrated part's microstructure.

Certain alloy additions modify the microstructure of the Fe—C alloy system by precipitating graphite, i.e., graphitization, in place of iron carbide. Graphitizing elements in order of decreasing graphitizing power include silicon and nickel. Both silicon and nickel provide alloy systems having ternary phase relations that are similar to those of the Fe—C system. Preferably, the graphitizing alloy is silicon.

Preferably, when selecting the Fe—C—Si alloy system, the infiltrant composition and the base compact composition, prior to infiltration, are composed of from about 0.01 to about 2.0 weight percent silicon. More preferably, the infiltrant composition and the base compact composition, prior to infiltration, are composed of from about 0.25 to about 1.25 weight percent silicon, and still more preferably from about 0.5 to about 1.0 weight percent silicon. Even more preferably, the infiltrant composition and the base compact composition, prior to infiltration, are composed of from about 0.7 to about 0.80 weight percent silicon, and still more preferably the infiltrant composition and the base compact composition, prior to infiltration, are composed of about 0.75 weight percent silicon. FIG. 3 shows a binary isopleth of the ternary Fe—C—Si system at 0.75% Si.

In one embodiment, the carbon content of the infiltrant composition, prior to infiltration, is a function of the silicon content of the infiltrant, X, according to the following equation:

$$\text{Carbon wt. \%=from } (4.24-0.33X)\% \text{ to } (4.64-0.33X) \text{ weight percent.}$$

Further, the carbon content of the base compact composition, prior to infiltration, is a function of the silicon content of the base compact, Y, according to the following equation:

$$\text{Carbon wt. \%=from } (1.75-0.17Y)\% \text{ to } (2.15-0.17Y) \text{ weight percent.}$$

In one embodiment, wherein the infiltrant composition is composed of a near hyper eutectic liquidus composition and the base compact is composed of a near hypo eutectic solidus powder composition, the infiltrant composition, prior to infiltration, is a function of the silicon content of the infiltrant, X, according to the following equation:

$$\text{Carbon wt. \%=from } (4.34-0.33X)\% \text{ to } (4.59-0.33X) \text{ weight percent.}$$

Further, the carbon content of the base compact composition, prior to infiltration, is a function of the silicon content of the base compact, Y, according to the following equation:

$$\text{Carbon wt. \%=from } (1.75-0.17Y)\% \text{ to } (2.03-0.17Y) \text{ weight percent.}$$

For Example, referring to FIG. 2, the carbon content on the isotherms of the binary isopleth in FIG. 2 are the equilibrium liquidus and solidus values at 1% Si. The carbon content of the base compact was either the ternary eutectic solidus value of 1.86% or a near hypo-solidus eutectic value in the range from about 1.71 to about 1.86%. Assuming a base compact density of 6.7 g/cm$^3$ and an Infiltrant weight of 90% of the full density value as indicated in Table 1, the carbon content of the infiltrated part is from about 1.97 to about 2.11%, i.e. from [1.71+(0.9)(0.143)(4.01)]/[1+(0.9)(0.143)]% to [1.86+(0.9)(0.143)(4.01)]/[1+(0.9)(0.143)].

The process temperature for the Fe—C—Si alloy system is preferably, from about 1163 to about 1177° C., (i.e. 2125 or 2150° F.), more preferably the process temperature is more than 1177° C. so as to provide a liquid phase content of at least about 15%.

Silicon content above 1.0 weight percent graphitizes substantially all hyper-eutectoid carbon of infiltrated parts. The resulting microstructure of the infiltrated part shows that silicon additions substantially reduce or eliminate coarse hyper-eutectoid grain boundary carbides that are common in Fe—C alloy systems. Typical microstructures at this silicon content show graphite precipitates of mixed nodular and compacted morphologies in a predominantly pearlitic matrix. As such, the resulting microstructure includes characteristics of compacted graphite and ductile cast irons and, consequently exhibits comparable mechanical properties.

Precipitation of graphite also changes the pore free density of the alloy. Since the density of graphite is lower than the density of carbide, the general effect of increasing graphitization is to decrease the pore free density. Table 3 shows the decrease in pore free density as graphitization increases and the composition of the resulting microstructure. The "Total Carbon" identified in Table 3 is the mean carbon content after infiltration, i.e. carbon content of an infiltrated from 1.97 to about 2.11%, in the Fe—C—Si system.

TABLE 3

Effects of Graphitization on the Infiltrated Pore Free Density and Microstructure of an Fe—C—Si Alloy at 1% Silicon

| Composition | | | | Microstructure | | | |
|---|---|---|---|---|---|---|---|
| Total Carbon (wt. %) | Graphitization (wt. %) | Residual $Fe_3C$ (wt. %) | Pore Free Density (g/cm$^3$) | Graphite (vol. %) | Grain Boundary $Fe_3C$ (vol. %) | Pearlite (vol. %) | Ferrite (vol. %) |
| 2.04 | 0 | 30.5 | 7.67 | 0.0% | 23.6 | 76.4 | 0.0 |
| 2.04 | 25 | 22.9 | 7.61 | 1.7% | 14.8 | 83.5 | 0.0 |
| 2.04 | 50 | 15.3 | 7.55 | 3.3% | 6.2 | 90.5 | 0.0 |
| 2.04 | 66.2 | 10.3 | 7.52 | 4.2% | ~0.0 | 95.8 | 0.0 |
| 2.04 | 75 | 7.6 | 7.49 | 4.9% | ~0.0 | 69.7 | 25.4 |
| 2.04 | 100 | 0.0 | 7.43 | 6.5% | ~0.0 | 0.0 | 93.5 |

Increasing the total carbon content by about 0.05 weight percent at about 1.0 weight percent silicon increases the potential density of the infiltrated part by about 0.01 g/cm$^3$. Eutectoid compositions in the Fe—C—Si system having 1% silicon include about 0.69 weight percent carbon. Thus, the hyper-eutectoid carbon content of the alloy in Table 3 is determined according to the following equation:

$$\text{Hyper Eutectoid Carbon}=100\ (2.04-0.69)/2.04$$

or 66.2% of the total carbon content. Hence, if 1.0 weight percent silicon is effective to graphitize the hyper-eutectoid carbon present in a composition, then as shown in bold in Table 3, the pore free density of the infiltrated part is about 7.52 g/cm$^3$.

High silicon concentrations in the base compact adversely effect the behavior of the infiltrant. Without being limited by theory, it is believed that increases in the silicon content of the base compact increase the contact angle of the infiltrant and thereby decrease the capillarity of the system. The reduced capillarity is indicated by the presence of a residual tab of un-infiltrated material at the surface of the compact. The effect is to decrease in the final infiltrated density of the compact. Generally, up to a silicon content of 0.75 weight percent, the capillarity of the system decreases as the silicon content of the base compact increases. For example, infiltrated parts having 0.5 weight percent silicon were infiltrated to a lesser extent compared to infiltrated parts having lower silicon content, such as for example, 0.25% or 0%, when infiltrated under the same conditions. Alternatively, base compacts having a silicon content of 1.25 weight percent do not exhibit less infiltration compared to base compact having a silicon content of 0.75 weight percent, when infiltrated under the same conditions.

The dimensional change of the base compact is used to measure the benefits of sintering. Dimensional change is a useful means of measurement because independent of sintering, dimensional change is not affected by other process factors, such as for example infiltrant weight, which contribute to density change.

Dimensional change is determined as a percentage change in the longest lateral dimension of the part versus the corresponding dimension either of the compaction die, (i.e. as the dimensional change from die), or of the part in the as-compacted or so-called green state, (i.e. as the dimensional change from green). Essentially, either method of measuring dimensional change reflects the same phenomena.

The potential for densification diminishes as the silicon content of the base compact increases. This result is unexpected because the largest increases in density due to sintering are normally associated with liquid phase sintering after infiltration. Normally, the potential for densification by liquid phase sintering increases as the amount of liquid component of the infiltrant increases. In the Fe—C—Si alloy system, increasing the silicon content of the base compact increases the amount of the liquid component of the infiltrant, when infiltrated under similar process and composition conditions. Upon liquid phase sintering, was expected to increase the density of the infiltrated part.

Without being limited by theory, it is believed that silicon has an adverse effect on the dihedral angle of the system. Like the contact angle, the dihedral angle is another surface property of the system. While it has no known effect on the capillarity, it does effect the potential for liquid phase sintering. For example, the simple presence of a liquid phase in a porous compact does not guarantee densification by liquid phase sintering. For sintering to occur, the liquid must penetrate the interparticle boundaries and form a continuous film that envelops most, it not all, of the particles of the solid phase. The amount of liquid needed to do this is largely determined by the dihedral angle. The relationship between the two is complex but, in general, the lower the dihedral angle, the lower the required liquid phase content. Thus, the fact that the incremental increases in density due to sintering decreased with increasing silicon in spite of concomitant increases in the liquid phase content after infiltration is a strong indication of increases in the dihedral angle.

However, the fact that the potential for densification due to sintering decreased at high silicon contents does not suggest that densification is impossible at high silicon contents. On the contrary, at high silicon contents, increasing the process temperature will increase the potential for densification due to sintering.

For example, a base compact with a silicon content of 1.25% fails to achieve full density at an infiltrant weight of 90% of the full density weight when infiltrated at 1185° C., (2165° F.), in spite of an indicated liquid phase content after infiltration at this temperature of nearly 20%. Yet, at a temperature of 1200° C., (~2190° F.), the apparent resistance of the high silicon content to densification is overcome.

There is an inherent danger in increasing the process temperature, however, because increasing the process temperature also increases the amount of liquid component of the infiltrated compact. In the above example, the liquid phase of the infiltrated compact was about 24%. When the liquid phase component of the infiltrated compact is greater than about 25%, there is a greater potential for gross shape distortions by slumping. However, at about 24% no evidence of slumping was exhibited in small parts The degree of graphitization is important because the presence of even a small content of coarse hyper-eutectoid grain boundary carbide in the microstructure of a part can have an adverse effect on the resultant mechanical properties. Thus, the particular graphitization that was specifically of interest was the graphitization of the hyper-eutectoid carbon, (hereafter, HEC), content as previously defined. Although the final infiltrated density of the part reflects the degree of graphitization, its determination of is principally by metallography. Typically, partial or incomplete graphitization of the HEC is evidenced by the presence of coarse grain boundary carbides in the microstructure which are fairly easy to detect. Nevertheless, the determination is somewhat approximate, especially as the graphitization approaches the limiting condition of complete graphitization of the HEC. Incomplete graphitization at this point is better indicated by an infiltrated density value that is higher than the calculated pore free value that specifically corresponds to complete graphitization of the HEC of the composition as exemplified in the earlier Table 3.

Preliminary trials showed that other than the silicon content, the degree of graphitization was dependent on the cooling rate after infiltration. As a consequence, the present studies of this were done in the production belt furnace which is known to have a cooling rate that is reasonably typical of normal P/M processing. The relevant temperature range in this regard was determined to be from about 725 to 1150° C., (i.e. 1350 to 2100° F.). The cooling rate of a standard Green Strength specimen, (ASTM B 312), in this furnace as averaged over the indicated temperature range was determined to be about 20° C./min., (i.e. ~35° F./min).

In general, the studies showed that the degree of graphitization increased directly as the silicon content of the base compact. Unexpectedly, however, the silicon content of the Infiltrant appeared to have little to no effect on the extent of graphitization except at very low base compact silicon contents. For example, when infiltrated with an Infiltrant that contained 0.50% silicon, a base compact which had no silicon other than the residual silicon of the base powder exhibited limited graphitization just under the infiltrated surface where the local cooling rate was presumably lowest but carbide precipitation elsewhere. In contrast, a base compact which contained 0.50% silicon exhibited marginally complete graphitization when infiltrated with an Infiltrant that essentially contained no silicon. Evidently, the silicon of the base compact is more effective than the silicon of the liquid in pre-empting carbide precipitation by nucleating graphite. Presumably, however, this is primarily a matter of kinetics since if there is no silicon in the base compact, then the silicon of the liquid will effect graphitization provided the cooling rate is slow enough.

The aforementioned graphitization in the base compact which contained 0.50% silicon was marginally complete in the sense that it was complete in some specimens but only very nearly complete in others. At base compact silicon contents of 0.75% and higher, the degree of graphitization was complete in all cases.

Processing Effects on Graphite Morphology

In the early studies of the effects of silicon on graphitization, the main microstructural issue was the elimination of the coarse hyper-eutectoid grain boundary carbides. Thus, very little attention was paid to the morphology of the resulting graphite precipitates or, more generally, to certain other outcomes of the process including especially, the dimensional change value. As previously indicated, the process temperature in these early studies was typically set without regard for the liquid phase content except to insure that it was high enough to avoid the possible adverse effects of diffusional solidification. Thus, the process temperature in most cases was 1163° F., (2125° F.), with an occasional trial at 1177° C., (2150° F.), and all of the studies were done in the laboratory batch furnace. The resulting graphite precipitates were of both the nodular and the compacted morphologies. The nodular morphology appeared to be the dominant one of the two but their actual contents by volume were never quantified. It's note worthy that in the open literature, the nodular morphology is sometimes synonymously described as spheroidal and the compacted morphology is likewise sometimes described or referred to as vermicular.

Later, in studies aimed at learning how to control the dimensional change value, as described in the next section, higher process temperatures in the neighborhood of 1185° C., (2165° F.), were determined to be necessary. Since microstructure was basically not at issue in these studies, it was typically not examined. However, in retrospect, it was subsequently found that the increased temperatures had effected a profound change in structure and specifically, in the graphite morphology. Accordingly, the compacted graphite morphology was now not only dominant, it was virtually the only graphite morphology present.

Still later, in studies initially aimed at transferring the processing from the laboratory batch furnace to the production belt furnace and immediately thereafter in the studies aimed at determining the effects of the base compact silicon content on the degree of graphitization, concurrent metallographic examinations showed yet another change. In this case, the compacted graphite morphology was dominant at low process temperatures as well as at high temperatures. Based on qualitative estimates, the nodular morphology at low process temperatures seldom exceeded about 30% of the total volume of graphite that was present in the structure and was typically lower than this in most cases. At high process temperatures, the nodular morphology was virtually non-existent.

The graphite morphology of infiltrated parts is comparable to the morphology of cast iron parts. Thus, the mechanical properties of infiltrated parts are comparable, or superior, to the mechanical properties of cast iron systems.

Comparative Cast Iron Properties

The graphite morphology is important because it has a major effect on the mechanical properties that can be developed in the resulting part. This is well known in the Cast Iron Industry where the various grades of cast iron are classified in terms of the dominant graphite type that is present in the microstructure. Thus, in Grey cast iron, the dominant graphite morphology is the flake type whereas in Compacted Graphite or so-called CG cast iron, it is the compacted type and in Ductile cast iron, it is the nodular type. As between these three grades, the Ductile irons reportedly offer the greatest potential in terms of mechanical properties with the CG irons a close second and the Grey irons a distant third. In addition, it's of interest to note in this regard that the networks of coarse hyper-eutectoid grain boundary carbides which typified the microstructures of the early infiltrated compositions in the Fe—C system are the dominant microstructural feature in White cast iron. This is potentially important because Malleable cast iron which reportedly exhibits mechanical properties that rival those of the Ductile and CG grades, is produced by heat treatment of White cast iron; the implication being that the infiltrated Fe—C alloys of the invention offer the possibility to be malleabilized by the same or by a similar treatment.

As indicated in the preceding section of the specification, the dominant graphite morphology of the microstructures of the preferred compositions of the invention was the compacted type. Thus, the mechanical properties of these compositions are directly comparable to those of the CG irons. Hence, for purposes of comparison, the mechanical properties of two grades of CG cast iron in the as-cast and heat treated conditions as reported in the open literature are presented below in Table 4.

TABLE 4

Typical Mechanical Properties Of Compacted Graphite Cast Irons*

| | Iron Matrix | Tensile Strength | | Yield Strength | | Elongation | Hardness | Nickel |
|---|---|---|---|---|---|---|---|---|
| Condition | (a) | MPa | (ksi) | MPa | (ksi) | % | HB | % |
| As-Cast | 60% F | 325 | (47.1) | 263 | (38.1) | 2.8 | 153 | — |
| Annealed (b) | 100% F | 294 | (42.6) | 231 | (33.5) | 5.5 | 121 | — |
| Normalized (c) | 90% P | 423 | (61.3) | 307 | (44.5) | 2.5 | 207 | — |
| As-Cast | . . . | 427 | (61.9) | 328 | (46.7) | 2.3 | 196 | 1.5 |
| Annealed (b) | 100% F | 333 | (48.3) | 287 | (41.6) | 6.0 | 137 | 1.5 |
| Normalized (c) | 90% P | 503 | (73.0) | 375 | (54.4) | 2.0 | 235 | 1.5 |

(a) F, ferrite; P, pearlite.

(b) Annealed, 2 hr. at 900° C. (1650° F.), furnace cooled to 690° C. (1275° F.), held 12 hr., cooled in air.

(c) Austenitized 2 hr. at 900° C. (1650° F.), cooled in air.

*"Cast Irons", ASM Specialty Handbook, J. R. Davies, Editor, ASM International, Materials Park, OH, pp 85.

As will be shown, the tensile properties of the infiltrated compositions of the invention-were generally superior to the best of the properties listed in this table. Thus, it was considered relevant to broaden the comparison to include the properties of the Ductile irons as well. These are shown below in Table 5.

TABLE 5

Mechanical Properties Of Various Ductile Cast Irons In The As-Cast Condition**

| | Chemistry | | | | | | Mechanical Properties & Structure | | | | | |
|---|---|---|---|---|---|---|---|---|---|---|---|---|
| | C | Si | Cu | Ni | Mn | Mo | Tensile Strength | | Yield Strength | | Elongation | Pearlite |
| No | % | % | % | % | % | % | MPa | (ksi) | MPa | (ksi) | % | % |
| 1 | 3.5 | 2.1 | 0.2 | — | — | — | 614 | (89) | 359 | (52) | 7 | 53 |
| 2 | 3.9 | 2.4 | 0.2 | — | 0.5 | — | 586 | (85) | 338 | (49) | 13 | 41 |
| 3 | 3.6 | 2.4 | 0.2 | 1.1 | 0.2 | — | 683 | (99) | 428 | (62) | 11 | 47 |
| 4 | 3.6 | 2.6 | 1.0 | — | 0.3 | — | 855 | (124) | 428 | (62) | 3 | 90 |
| 5 | 3.6 | 2.5 | 0.2 | — | 0.6 | 0.2 | 538 | (78) | 345 | (50) | 16 | 26 |

**"Cast Irons", Ibid., pp 70

Finally, it's also appropriate to note that because of their higher carbon and silicon contents, the densities of the cast irons are appreciably lower than the densities of the infiltrated compositions of the invention. This difference is thought to explain the previously noted improvements in the mechanical properties of the present compositions over the CG cast irons. For example, the carbon and silicon contents of the various grades of the CG and Ductile cast irons each average about 3.6% and 2.5% respectively. In contrast, the carbon and silicon contents of the preferred compositions of the invention average about 2.0% and 0.75% respectively. The pore free densities corresponding to these values for different degrees graphitization are approximately the same as shown in the earlier Table 3. The pore free densities corresponding to the higher carbon and silicon contents of the cast irons for different degrees of graphitization in the as-cast condition are shown below in Table 6.

TABLE 6

Pore Free Densities Of Cast Irons In The As-Cast Condition At 2.5% Silicon

| Composition | | | | Microstructure | | | |
|---|---|---|---|---|---|---|---|
| Total Carbon wgt % | Graphitization wgt % | Residual $Fe_3C$ wgt % | Pore Free Density g/cm$^3$ | Graphite vol % | Grain Boundary $Fe_3C$ vol % | Pearlite vol % | Ferrite vol % |
| 3.6 | 82.8 | 9.3 | 7.16 | 9 | ~0 | 91 | 0 |
| 3.6 | 85 | 8.1 | 7.15 | 9 | ~0 | 79 | 11 |
| 3.6 | 90 | 5.4 | 7.13 | 10 | ~0 | 53 | 37 |
| 3.6 | 95 | 2.7 | 7.11 | 10 | ~0 | 26 | 63 |
| 3.6 | 100 | 0.0 | 7.09 | 11 | ~0 | 0 | 89 |

The data in this table are based on essentially the same considerations that led to the data in Table 3. One difference, however, is that the eutectoid carbon content at 2.5% silicon is about 0.62% rather than 0.69% as earlier. Thus, complete graphitization of the hyper-eutectoid carbon in this case, as indicated in the row highlighted by the boldface numerals, corresponds to 82.8% graphitization of the total carbon content rather than 66.2% as earlier. Nevertheless, the microstructures in the two cases are similar in that both may be described as being composed of graphite precipitates in an otherwise exclusively pearlitic matrix, (i.e. with negligible contents of coarse hyper-eutectoid grain boundary carbides and/or free ferrite).

Potential to Control the Dimensional Change in Iron Base Infiltration

An inherent economic advantage of the P/M process is that parts can be made directly to net shape with little or no need of machining or re-sizing by deformation methods as for example, coining or re-pressing. The important process parameter in this regard is the dimensional change that the part undergoes during the process relative to the original die size. The ideal outcome of the process is a zero or near zero net change in the critical dimensions of the part, (e.g. typically, one or both of the lateral dimensions), versus those of the die. In actual practice, however, this ideal is seldom realized because the dimensional change is dependent on both the composition and the processing which are subject to other considerations as well. As a consequence, parts are commonly designed to accommodate a fairly wide range of dimensional change, typically as wide as ±0.5% of die and on occasion even as wide as ±1.0% of die. Where tight tolerances can not be avoided, the preferred range is much narrower at about ±0.35% of die.

In iron base infiltration, two circumstances combine to create a potential to control the dimensional change of the resulting parts to values in the ±0.35% of die range. One circumstance is that the compositions are such that when the parts are infiltrated to full density by setting the infiltrant weight to the full density value, (i.e. without benefit of liquid phase sintering after infiltration), the dimensional change is typically in excess of 0.5% of die and may be as high as 1.25%. The other circumstance is that once infiltration is complete, the resulting compositions comprise supersolidus liquid phase systems that are capable of providing significant densification by liquid phase sintering and hence, decreased dimensional change values, provided sufficient residual porosity exists to permit the sintering to occur.

To take advantage of the potential inherent in these circumstances, it's necessary to: 1) provide the indicated residual porosity after infiltration by setting the infiltrant weight to a value that is suitably below the full density value to effect the desired decrease in dimensional change; and, 2) employ process conditions that will promote sufficient densification by liquid phase sintering after infiltration to effect the full density value, (i.e. to eliminate the residual porosity). In practice, the required infiltrant weight is determined empirically by trial and error. As will be seen, for the simple part geometry that was used in the studies to exemplify the method, the required weight was determined to be approximately 75 to 85% of the Infiltrant Weight to Full Density value as indicated in the earlier Table 1. The process conditions that are otherwise needed to implement the method include primarily the process temperature and the time at temperature. Both are decided precisely in accordance with the rules as earlier set-out to determine these parameters. In particular, the process temperature should be determined in accordance with the phase relations to provide a minimum liquid phase content after infiltration of about 15%. In the case of the time, the findings were generally the same as indicated in the defining studies. Accordingly, the time should be at least 15 minutes and more preferably, about 30 minutes at temperature. If the process temperature is set lower than the value corresponding to a liquid phase content of 15%, then it may be found that longer times are needed to effect the full density condition in the final infiltrated part.

Dimensional Uniformity of Infiltrated Parts

In view of the novelty of the iron base infiltration process, it was decided at an early stage of the studies to include dimensional uniformity checks in addition to the usual part measurements that are typically made in P/M research. As it turned out, the very first checks of this property showed the existence of a type of dimensional non-uniformity that may be unique to iron base infiltration and which subsequently came to be called the distortion effect.

As a general matter, the distortion effect is a result of density gradations in the infiltrated compact that are manifest as a disparity in the lateral dimensions of the infiltrated and opposing uninfiltrated surfaces. The greatest variations always appear to occur immediately under the infiltrated surface to a depth of a few millimeters but may occur elsewhere as well. As a consequence, the magnitude of the effect is measured simply as the difference in the lengths of the infiltrated and opposing uninfiltrated surfaces. Typically, the effect is large enough that if not otherwise mitigated, the resultant parts will require a machining step before they can be put into service in all but the least demanding applications.

It was determined that the effect has two general causes. The primary cause is liquid penetration and separation of the sinter bonds of the particles in and just under the surface of the Base Compact followed by lateral expansion of the affected elements under the influence of the surface tension forces that act on the uninfiltrated liquid. The secondary cause is incomplete graphitization of the hypereutectoid carbon content of the compact. Distortion due to the liquid penetration mechanism is generally always observed and is normally fairly substantial in magnitude. In comparison, distortion due to incomplete graphitization only occurs intermittently and is generally of a smaller magnitude. It is generally not observed in Base Compacts that are processed with silicon contents in the preferred range of the invention.

Theoretical considerations suggested that the effect can be mitigated either by alloying or by processing. The idea in both cases is essentially to forestall liquid penetration of the sinter bonds of the Base Compact until the infiltration step is complete. A substantial effort to implement this idea by an alloying method is the subject our U.S. Provisional Application No. 60/619,169, filed Oct. 15, 2004. A processing method is briefly described below.

Pre-Sintering to Mitigate the Distortion Effect

The specific idea to use pre-sintering to mitigate the distortion effect is to strengthen the sinter bonds of the Base Compact in advance of infiltration so that they will be more resistant to penetration by the liquid during infiltration. In normal processing, the infiltrant and Base Compact are heated directly to the infiltration temperature in a relatively short period of time. As a consequence, the sintering that occurs in the Base Compact in advance of infiltration is limited and the resulting sinter bonds are not as well formed or nearly as strong as they could be if the processing provided for more sintering in this phase of the process. In fact, there are three possible methods to do this as follows: 1) Decrease the rate at which the Infiltrant and Base Compact are heated to the infiltration temperature; 2) Interpose a pre-infiltration sintering step in the process; or 3) Pre-sinter the Base Compact in a separate operation before submitting it to the infiltration process. The effectiveness of Methods 1 and 3 to reduce the distortion effect is demonstrated in Example 7. Since Method 2 is, in essence, a special case of Method 1, its anticipated that it will be equally or more effective in this regard.

EXAMPLES

The test methods and procedures used in the Examples are the same as the ones that were generally used in the development of the iron base infiltration process. The materials used in the Examples, however, reflect what is thought to be best in terms of implementing the process as a practical matter and do not include all of the materials that were actually studied.

Test Methods and Special Procedures

The green, sintered and infiltrated properties that were of primary interest in assessing the efficacy of the process were the green, sintered and infiltrated densities and dimensional change values. The densities in each case were determined in accordance with ASTM B331 and the dimensional change values, in accordance with ASTM B610. The mechanical properties that were of interest were the tensile and hardness properties. The tensile properties were determined in accordance with ASTM E8. The hardness values were normally determined on the surface opposite the infiltrated surface of the specimen. The measurements were made on the Rockwell A scale, (i.e. using a diamond indenter and 60 kgf load), in accordance with ASTM E140.

Three Base Compact geometries were employed in the course of the studies. Virtually all of the infiltration studies were done with compacts in the form of standard Transverse Rupture Strength specimens, (ASTM 528), but to a nominal constant weight of 35 grams throughout, (i.e. to a nominal heights in the range of 12.5 to 13 mm). The tensile property determinations were based on a standard PIM dog-bone tensile bar geometry in accordance with MPIF 10. As indicated in the Examples, the compacts were compacted to specified densities that were typically equal to or less than 6.8 g/cm$^3$. The corresponding Infiltrant slugs were compacted in the same dies as the Base compacts but to specified weights as also indicated in the Examples. Typically, the weight was decided in accordance with the "Infiltrant Weight To Full Density" values as listed in the earlier Table 1. A standard pressure of 552 MPa, (40 tsi), was used in compacting the slugs.

Laboratory Mixing and Binder Treatment Processing—

The mixes that are described in the Examples were all less than 2500 grams and were made using standard laboratory bottle mixing equipment. Infiltrant mixes were typically 200 grams and base compact mixes, 1000 grams. The total mixing time was uniformly 30 minutes per mix. In compositions adding zinc stearate, the iron base powder and the stearate addition were pre-blended for 15 minutes prior to adding the balance of the admix ingredients. Subsequent to mixing, the mixes were passed through a standard 60 mesh screen to remove lubricant agglomerates and then submitted to binder treatment processing. The latter consists of uniformly heating the mix in a stainless steel mixing bowl to the binder solution temperature, typically ~40 to 45° C., prior to bonding. In the mean time, the binder addition, typically 0.25% by weight in the case of the Base Compact mixes and 0.35% in the case of the Infiltrant mixes, is dissolved as a 5% solution by weight in acetone. The solution is then added to the mix and quickly blended in either manually using a stainless steel utensil or by means of a food mixer that is specially equipped with the appropriate Nema controls to prevent electrical discharge. (This step is always done within the confines of a chemical hood and generally with the benefit of personal safety gear which typically includes a face shield and gloves). After the solution is thoroughly blended into the powder, the mix is normally spread out on clean sheets of paper and allowed to dry, usually overnight, by evaporation. Vacuum processing to speed drying is also occasionally used. After drying, the mixes are again passed through a 60 mesh screen to remove agglomerates prior to use.

Carbon Losses To The Oxygen Of The Base Powder—

The carbon losses to the oxygen of the iron base powder that are expected during processing were calculated as follows:

$$\% C=0.75(O\%-0.02), \quad 2)$$

where % C are the losses and O % is the oxygen content of the powder in weight percent.

Graphite Admix Additions—

The graphite addition needed to produce a particular carbon content in compacts of the admixture during processing was calculated as follows:

$$\% \text{ Graphite}=[\% \text{ Aim Carbon}+0.75(O\%-0.02)]/(\text{Fractional Purity Of The Graphite}) \quad 3)$$

where O % is the oxygen content of the iron base powder of the admixture in weight percent.

Materials Used in the Examples

Following is a list of the materials that were used to generate the Examples.

Iron Base Powders—

Three iron base powders as commercially available from the Hoeganaes Corporation, Cinnaminson, N.J. were used. These included: Ancorsteel 1000 B, Ancorsteel 50 HP and Ancorsteel 4600 V. All three of these powders are made by water atomization and have similar typical particle size distributions as shown below in Table 7.

Ancorsteel 1000 B is a commercially pure iron powder with a residual impurity content of less than 0.35% by weight.

Ancorsteel 50 HP is an iron base pre-alloyed powder nominally containing 0.5% molybdenum and 0.15% manganese by weight. Residual impurities typically average less than 0.25% by weight.

Ancorsteel 4600 V is an iron base pre-alloyed powder nominally containing 0.5% molybdenum, 1.8% nickel and 0.15% manganese by weight. Residual impurities typically average less than 0.25% by weight.

TABLE 7

Typical Particle Size Distributions Of The Iron Base Powders

| Particle Size In Micrometers | | | |
|---|---|---|---|
| +250 | −250/+150 | −150/+45 | −45 |
| Equivalent Standard US Screen Sizes In Mesh | | | |
| +60 | −60/+100 | −100/+325 | −325 |
| Screen Analysis In Weight Percent | | | |
| Trace | 12 | 66 | 23 |

Admix Alloy Additions—

Following is a list of the alloy additions that were used in the Infiltrant and Base Compact compositions.

Graphite—Grade 3203 HS, is a product of Asbury Graphite Mills Inc. Asbury, N.J. Grade 3203 is a naturally occurring graphite with a typical minimum carbon content of 95% by weight and an average particle size of less than 10 micrometers. The actual carbon content of the particular lots of this grade graphite that were used were determined to be slightly in excess of 0.97% by weight.

Graphite—Grade KS-10, is a product of Timcal Graphite Company, division of Timcal Ltd., Switzerland. Grade KS-10 is a synthetic graphite with a minimum carbon content of 99% and an average particle size of less than 10 micrometers.

Black Silicon Carbide, (SiC), Grade F-600, is a product of the Saint-Gobain Ceramics Company, Worchester, Mass. The Grade F-600 is a commercially pure SiC nominally containing 70% silicon and 30% carbon having an average particle size under 15 micrometers.

20% Si Ferrosilicon, is a proprietary product of the Hoeganaes Corporation. This is a ferrosilicon powder that nominally contains 20% silicon by weight which is made specifically for application in Hoeganaes proprietary admix compositions. It is produced by water atomization and subsequently milled to an average particle size of less than 10 micrometers.

Nickel Powder—Grade 123, is a product of the International Nickel Company, Toronto, Ontario, Canada. Grade 123 is a commercially pure derivative of carbonyl nickel with an average particle size in the range of 6 to 8 micrometers.

Copper Powder—Grade 3203, is a product of Acupowder International, LLC, Union, N.J. This is a commercially pure copper powder as made by water atomization with an average particle size of less than 55 micrometers.

ManganeseSilicoIron, is a proprietary product of the Hoeganaes Corporation. This is an manganese-silicon-iron prealloy that nominally contains 45% manganese and 20% silicon by weight; with the balance being iron and residual impurities. Here again, this alloy is made specifically for application in Hoeganaes proprietary admix compositions. It is produced by water atomization and subsequently milled to an average particle size of less than 10 micrometers.

Organic Additives—

Following is a list of the organic additives that were used in the Infiltrant and Base Compact compositions.

Acrawax C, is a product of the Lonza Division of IMS Company, Chagrin Falls, Ohio. Acrawax C is a powder grade of Ethylene-bis-Stearamide that is admixed as a metal powder lubricant.

Zinc Stearate, is a product of Baer Locher, LLC, Cincinnatti, Ohio. This is a commercially pure grade of zinc stearate.

Polyethylene Oxide—Grade N10 & Polypropylene Copolymer—"PolyGlycol 15-200", are both products of the Dow Chemical Company, Houston, Tex. Both materials are ingredients in a proprietary, (U.S. Pat. No. 5,298,055), Hoeganaes Corporation binder synonymously called ANCORBOND II. It is nominally composed of 70% Grade N10 and 30% "PolyGlycol 15-200".

Polyethylene Glycol—Grade 35000, is a product of the Clariant Corporation, Monroe, N.J. This is a commercially pure grade of polyethylene glycol having an average molar mass of ~35000 g/mol.

EXAMPLES

The following examples, which are not intended to be limiting, present certain embodiments and advantages of the present invention. Unless otherwise indicated, all percentages are on a weight basis.

Example 1

This example illustrates the densities and microstructures typical of infiltration in the Fe—C system. The iron base powder used in both the Infiltrant and the Base Compact mixes was Ancorsteel 1000 B with an oxygen content of 0.12%. The aim carbon content of the Base Compact was 2.00% which is just below the eutectic solidus value at 2.03% as shown by the equilibrium phase relations in FIG. 1. The aim carbon content in the case of the Infiltrant was 4.34% which is the eutectic value as also shown in the figure. The corresponding admix compositions were as follows:

Base Compact Mix: [2.00+0.75(0.12−0.02)]/(0.97) % Asbury Grade 3203 HS Graphite, (hereafter, 3203 HS Graphite), 0.5% Acrawax C, balance Ancorsteel 1000 B and binder treated with 0.25% ANCORBOND II, (hereafter, ABII).

Infiltrant Mix: [4.34+0.75(0.12−0.02)]/(0.99) % Timcal Grade KS-10 graphite, (hereafter, KS-10 Graphite), balance minus 325 mesh Ancorsteel 1000 B and binder treated with 0.35% AB II.

The Base Compact mix was compacted into Transverse Rupture Strength, (hereafter, TRS), bars at a green density of 6.8 g/cm$^3$ and nominally weighing 35 grams. The Infiltrant mix was likewise compacted into TRS infiltrant slugs, (hereafter, slugs), weighing 4.5 grams. This is just short of the Infiltrant Weight To Full Density value indicated in the earlier Table 1. The Infiltrant slugs and Base Compacts were processed together at 1177° C., (2150° F.), for ½ hour at temperature in synthetic DA in the laboratory batch furnace. As an added precaution against carbon losses during processing, the specimens were processed in a graphite gettered sintering tray with a close fitting cover. The results of the trial are shown below in Table 8. The expected average carbon content of the final infiltrated specimen was 2.28%.

TABLE 8

Infiltrated Properties of an Fe—C Alloy at an Average Carbon Content of 2.28%

| Specimen Number | Density g/cm$^3$ | Dim. Chg. vs. Green % |
|---|---|---|
| 1 | 7.63 | −0.54 |
| 2 | 7.59 | −0.37 |
| Average | 7.61 | −0.46 |

According to the indications of the relation in the earlier Equation 1 and/or the data in Table 2, the pore free density of the alloy at this carbon content is about 7.70 g/cm$^3$. In comparison, the observed average density of 7.61 g/cm$^3$ is just under 99% of this value. The implication is that if the infiltrant weight had been greater by about 1% of the final total infiltrated weight, (e.g. by ~0.4 grams), it would have been sufficient to fill the remaining pores and effect infiltrated densities that approached the theoretical limit. However, there is also evidence in the data to suggest that simple pore filling is not all that is involved in the process. Based on the dimensional change values, its apparent that sintering also made a significant contribution to the observed densification. Thus, while the results clearly show that the infiltration process is capable of producing densities that approach the pore free value, it's equally clear that the underlying mechanism is not a simple volume displacement process but includes densification by solid state and, very probably, liquid phase sintering as well.

FIG. 4 shows a micrograph of a typical Fe—C alloy in the as-infiltrated condition. The relative density in this case was just under 98%. Apart from the pores, the evident microstructural features shown in the figure include a predominantly pearlitic matrix in an essentially continuous network of hyper-eutectoid grain boundary carbides. Owing to the presence of the grain boundary carbides, the mechanical properties of the alloy were not expected to be much better than those of a standard low density press and sinter composition of similar pearlite content and were consequently not determined. It was likewise evident that it would be necessary to find suitable ways to modify the structure and, in particular, to disrupt or, better yet, eliminate the grain boundary carbides if iron base infiltration was to provide the improved mechanical properties that its demonstrated potential in terms of density suggested were possible.

Example 2

This example illustrates the densities and microstructures typical of infiltration in the Fe—C—Si system. The iron base powder used in both the Infiltrant and the Base Compact mixes was Ancorsteel 1000 B with an oxygen content of 0.08%. The admix silicon content was in the form of a 1.5% SiC addition and was nominally 1.05%. The aim carbon content of the Base Compact was 1.75% which is 0.11% below the eutectic solidus value at 1.86% as shown by the ternary isopleth at 1% Si in FIG. 2. The aim carbon content in the case of the Infiltrant was 4.00% which is just below the eutectic value as also shown in the figure. The corresponding admix compositions were as follows:

Base Compact Mix: [1.75+0.75(0.08−0.02)−0.3(1.5)]/(0.97) % 3203 HS Graphite, 1.5% Saint-Gobain Ceramics—Grade F-600 SiC, (hereafter, F-600 SiC), 0.5% Acrawax C, balance Ancorsteel 1000 B and binder treated with 0.20% ABII.

Infiltrant Mix: [4.00+0.75(0.08−0.02)−0.3(1.5)]/(0.99) % KS-10 Graphite, 1.5% Grade F-600 SiC, balance minus 325 mesh Ancorsteel 1000 B and binder treated with 0.35% AB II.

The Base Compact mix was compacted into TRS bars at a green density of 6.7 g/cm$^3$ and nominally weighing 35 grams. The Infiltrant mix was compacted into slugs weighing 5.25 grams which is 0.25 grams in excess of the Infiltrant Weight To Full Density value indicated in the earlier Table 1. The two compacts were processed together at 1163° C., (2125° F.), for ½ hour at temperature in the laboratory batch furnace. The furnace atmosphere was synthetic DA and the specimens were processed in a graphite gettered sintering tray with a close fitting cover. The results of the trial are shown below in Table 9. The expected average carbon content of the final infiltrated specimen was 2.04%.

TABLE 9

Infiltrated Properties of an Fe—C—Si Alloy at an Average Silicon Content of 1.05%

| Specimen Number | Density g/cm$^3$ | Dim. Chg. vs. Green % |
|---|---|---|
| 1 | 7.53 | 0.48 |
| 2 | 7.50 | 0.65 |
| Average | 7.52 | 0.57 |

The findings in this instance can not be properly interpreted without reference to the microstructure. For example, while the density values are lower than earlier, it turns out that this is essentially a graphitization effect and contrary to being inferior, they are, on a relative density basis, actually slightly better than earlier. The microstructure is shown in FIG. 5.

A cursory comparison of the structural details in this figure with those of the earlier FIG. 4 will show that the silicon addition had a profound effect. Amazingly, it produced an apparently nodular cast iron structure. The eutectoid or near eutectoid pearlitic matrix that was seen in the earlier Fe—C alloy remains but the grain boundary networks of hyper-eutectoid carbides have virtually all been replaced by a random dispersion of graphite precipitates. The graphite precipitates that are most evident in the figure are of the so-called 'bull's-eye' variety. This type occurs chiefly in ductile or nodular cast irons and consists essentially of a spheroidal graphite nodule within an encapsulating annular sphere of ferrite. Less evident but also present in this micrograph and, more generally, in the numerous others that have been examined in this study are so-called vermicular or compacted graphite precipitates as well as occasional flake type precipitates. The latter morphologies occur chiefly in the so-called compacted and gray cast irons.

As explained earlier, corresponding to the change in microstructure, the precipitation of graphite also changes the pore free density of the alloy. As will be recalled, this is because the density of the graphite precipitates is lower than that of the carbides which they replace. The magnitude of the effect as determined on the basis of the pore free densities of the constituent phases is shown in the earlier Table 3. Notice that the total carbon value in this table is nominally the same as that of the subject composition.

The microstructure in the present case approximates to complete or near complete graphitization of the hyper-eutectoid carbon content of the alloy. According to the data in Table 3, complete graphitization of the hyper-eutectoid carbon corresponds to about 66% graphitization of the total carbon content. Hence, as indicated in the highlighted row of data in the table, the corresponding pore free density is 7.52 g/cm$^3$.

Now, returning to the infiltrated properties in Table 9, it will be evident that the observed density values approached the pore free density and, on a relative basis, are therefore comparable to the earlier results in the Fe—C system. On the other hand, in contrast with the earlier indications of significant densification by sintering in addition to infiltration, the present dimensional change values are positive and, of course, give no indication of a sintering contribution. Presumably, the relative increase in these values is another effect of the observed graphitization.

Example 3

This example illustrates the general effects of the silicon content of the Base Compact composition on various outcomes and properties of the infiltration process including the Ease Of Infiltration, the Density Increases Due To Sintering and the Degree of Graphitization as earlier defined. The results provided the basis for defining the previously indicated preferred range for the silicon content of the Base Compact composition.

Noteworthy materials differences relative to Examples 1 and 2 include the following: 1) The admixes in this case all employ a small addition of zinc stearate. Contemporaneous studies had shown that it had a beneficial effect on the graphite distribution within the mixes as manifest in fewer graphite agglomerates during screening after binder treatment processing. 2) A 20% Si ferrosilicon powder rather than SiC was used as the primary silicon source in both the Infiltrant and Base Compact compositions. Here again, separate studies had shown that the ferroalloy was quicker to dissolve than the compound and thus provided greater compositional homogeneity, especially in the Infiltrants. 3) Polyethylene Glycol-Grade 35000 was used to bond the mixes in place of the earlier ABII. 4) The Infiltrants are all eutectic or near hyper-eutectic compositions but are not equilibrium compositions for the various Base Compact compositions that are employed. In particular, one of the two Infiltrants employed in the study was one of the preferred Infiltrant compositions of the invention and contained no admixed silicon. This was the Infiltrant composition based on the Ancorsteel 4600 V powder.

In addition, the findings that are presented in the Example are the product of two different trials. In the first trial, the silicon contents of the various Base Compact compositions were in the range from 0 to 0.5% and the specimens were all processed in the laboratory batch furnace. In the second trial, the silicon contents of the various Base Compact compositions were in the range from 0.75 to 1.25% and the specimens were all processed in the production belt furnace. The rationale underlying the switch to the production belt furnace in the second trial was that its heating and cooling characteristics are significantly more typical of actual parts production than those of the laboratory batch furnace and it was evident from the results of the first trial that cooling especially had an important effect on the outcome of the process in terms of the Degree Of Graphitization property.

Trial 1 Compositions and Conditions—

The iron base powder used in both the Infiltrant and the Base Compact mixes was Ancorsteel 1000 B with an oxygen content of 0.10%. The trial included three Base Compact compositions with silicon contents of nominally 0, 0.25 and 0.50%. The aim carbon content of each of the compositions was 1.89% which is a near hypo-eutectic solidus value that is less than 0.15% below the eutectic solidus value in all three cases. The Infiltrant was made to a silicon content of 0.50%. The aim carbon content in this case was 4.22%. According to the Thermo-calc program, this is just above the eutectic value. The admix silicon in all four compositions was added in the form of a 20% silicon containing ferrosilicon alloy. The corresponding admix compositions were as follows:

Base Compact Mix 1: [1.89+0.75(0.10−0.02)]/(0.97) % 3032 HS Graphite, 0.45% Acrawax C, 0.10% Zinc Stearate, balance Ancorsteel 1000 B and binder treated with 0.25% Polyethylene Glycol-Grade 35000, (hereafter, PEG 35000).

Base Compact Mix 2: [1.89+0.75(0.10−0.02)]/(0.97) % 3032 HS Graphite, 1.38% 20% Si ferrosilicon, 0.45% Acrawax C, 0.10% Zinc Stearate, balance Ancorsteel 1000 B and binder treated with 0.25% PEG 35000.

Base Compact Mix 3: [1.89+0.75(0.10−0.02)]/(0.97)% 3032 HS Graphite, 2.75% 20% Si ferrosilicon, 0.45% Acrawax C, 0.10% Zinc Stearate, balance Ancorsteel 1000 B and binder treated with 0.25% PEG 35000.

Infiltrant Mix 1: [4.22+0.75(0.10−0.02)]/(0.99) % KS-10 Graphite, 2.75% 20% Si ferrosilicon, 0.10% Zinc Stearate, balance minus 325 mesh Ancorsteel 1000 B and binder treated with 0.35% AB II.

The Base Compact mixes were compacted into TRS bars at a green density of 6.7 g/cm$^3$ and nominally weighing 35 grams. The Infiltrant mix was compacted into slugs weighing 4.75 grams which is 0.25 grams less than the Infiltrant Weight To Full Density value indicated in the earlier Table 1. The slugs and Base Compacts were processed together at 1163° C., (2125° F.), for ½ hour at temperature in the laboratory batch furnace. The furnace atmosphere was synthetic DA and the specimens were processed in a graphite gettered sintering tray with a close fitting cover. The results of the trial are shown below in Table 10. The expected average carbon content of the final infiltrated specimens was 2.16%.

Trial 2 Compositions and Conditions—

The iron base powder used in the Base Compact mixes was Ancorsteel 1000 B with an oxygen content of 0.10%. The iron base powder used in the Infiltrant mix was Ancorsteel 4600 V with an oxygen content of 0.11%. The trial included two Base Compact compositions with silicon contents of nominally 0.75 and 1.25%, (i.e. Mixes 4 and 5 of the Example). The aim carbon content corresponded to the eutectic solidus value in each case and were 1.91 and 1.82% respectively. The admix silicon in both compositions was added in the form of a 20% silicon containing ferrosilicon alloy. The Infiltrant mix contained no silicon and the aim carbon content in this case was 4.43%. According to the Thermo-calc program, this is 0.15% above the eutectic value. The corresponding admix compositions were as follows:

Base Powder Mix 4: [1.91+0.75(0.10−0.02)]/(0.97) % 3032 HS Graphite, 3.875% 20% Si ferrosilicon, 0.45% Acrawax C, 0.10% Zinc Stearate, balance Ancorsteel 1000 B and binder treated with 0.25% PEG 35000.

Base Powder Mix 5[1.82+0.75(0.10−0.02)]/(0.97) % 3032 HS Graphite, 6.575% 20% Si ferrosilicon, 0.45% Acrawax C, 0.10% Zinc Stearate, balance Ancorsteel 1000 B and binder treated with 0.25% PEG 35000.

Infiltrant Mix 2[(4.43+0.75(0.11−0.02)]/(0.97) % 3032 HS Graphite, 0.10% Zinc Stearate, balance minus 325 mesh Ancorsteel 4600 V and binder treated with 0.35% PEG 35000.

The Base Compact mixes were compacted into TRS bars at a green density of 6.7 g/cm$^3$ and nominally weighing 35 grams. The Infiltrant mix was compacted into slugs weighing 4.75 grams which is 0.25 grams less than the Infiltrant Weight To Full Density value indicated in the earlier Table 1. The slugs and Base Compacts were processed together at 1182° C., (2160° F.), in the production belt furnace at a belt speed of 30.5 centimeters per minute, (1.2 inches per minute), corresponding to a time at temperature of about 40 minutes. The furnace atmosphere was synthetic DA and the specimens were processed in a graphite gettered sintering tray with a close fitting cover. The results of the trial are shown below in Table 11. The expected average carbon contents of the final infiltrated specimens for the 0.75 and 1.25% Base Compact silicon contents were 2.18 and 2.11% respectively.

A review of the results of the first trial in Table 10 will show that the different Base Compact silicon contents had very significant effects on the outcomes and properties of the final infiltrated specimens.

TABLE 10

Infiltrated Properties Of Base Compacts Of Mixes 1 Through 3

| Base Compact Silicon Content | Density g/cm$^3$ | Dim. Chg. vs. Green % | Infiltrated Surface Residue |
|---|---|---|---|
| 0.0% | 7.57 | −0.10 | None |
| 0.25% | 7.47 | +0.11 | Scattered Particles |
| 0.50% | 7.34 | +0.65 | Small Rectangular Tab |

Accordingly, the Ease Of Infiltration property as indicated by the amount and type of infiltrated surface residue decreased with increase in the Base Compact silicon content. Similarly, the Density Increases Due To Sintering as indicated primarily by the % lineal dimensional change from green values in the table likewise decreased with increase in the silicon content.

In contrast, metallographic examinations of the specimens showed that the Degree Of Graphitization increased with the increase in the Base Compact silicon content. This finding is indicated in Micrographs A and B of FIG. 6 and Micrograph A of FIG. 7. Graphitization at the 0 and 0.25% silicon levels was limited to the region just under the infiltrated surface of the Base Compacts in both cases. This is shown in Micrograph A of the FIG. 6. Although the structure that the micrograph depicts is typical of what was observed at both of the 0 and 0.25% silicon contents, it is actually based on the specimen representing the Base Compact that was made with 0% silicon. Evidently, the 0.5% silicon content of the Infiltrant composition in this case was sufficient to produce some graphitization in spite of the virtual absence of silicon in the Base Compact composition. The degree of graphitization typical of the 0.5% Base Compact silicon content is indicated in Micrographs B of the figure. The graphitization in this case was very nearly complete. In fact, Micrograph B shows that it was complete to the depth of the field just under the infiltrated surface and otherwise serves to indicate the structure in most of the rest of the specimen. Micrograph A of FIG. 7, on the other hand, shows the structure just above the bottom surface of the specimen. Here, where the cooling rate was presumably fastest, the micrograph shows a mixture of grain boundary carbides and graphite precipitates.

TABLE 11

Infiltrated Properties Of Base Compacts Of Mixes 4 and 5

| Base Compact Silicon Content | Density g/cm$^3$ | Dim. Chg. vs. Green % | Infiltrated Surface Residue |
|---|---|---|---|
| 0.75% | 7.49 | +0.46 | Small Rectangular Tab |
| 1.25% | 7.36 | +1.07 | Small Rectangular Tab |

A review of the results of the second trial in Table 11 will show precisely the same trend as earlier with respect to densification by sintering during the process. Here again, the significant increase in the dimensional change values with increase in the silicon content provides a strong indication of decreased densification due to sintering. Conversely, the differences in terms of the Ease Of Infiltration of these specimens generally did not show the same trend as earlier. The residual tabs in both cases were easily removed and exhibited similar weights equal to less than 2% by weight of the original infiltrant weights.

Figure 7A:
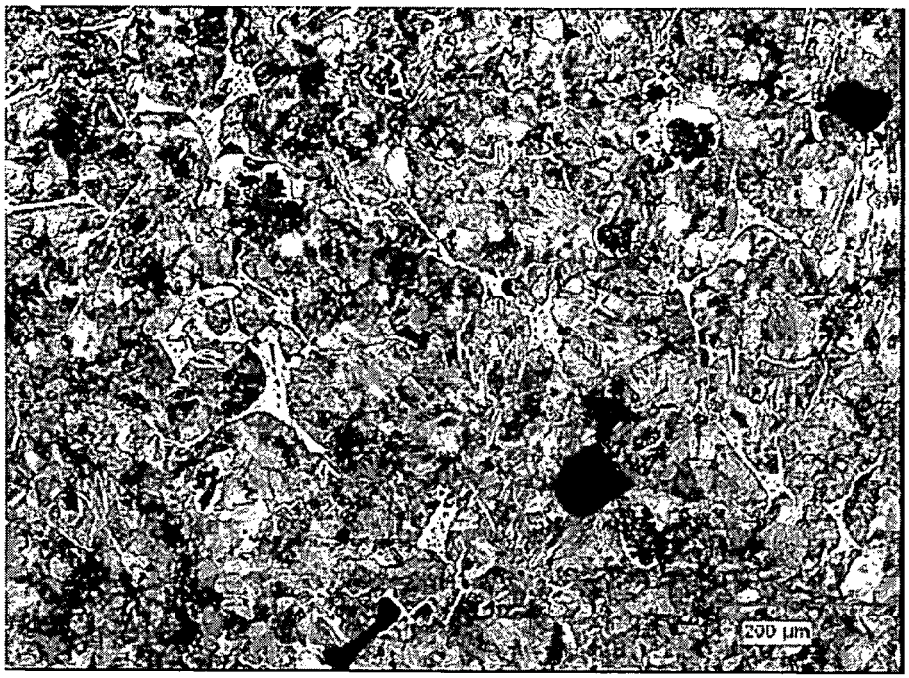
FIG. 7A is a micrograph of an infiltrated part composed of an Fe—C—Si alloy showing a degree of graphitization.
Figure 7B:
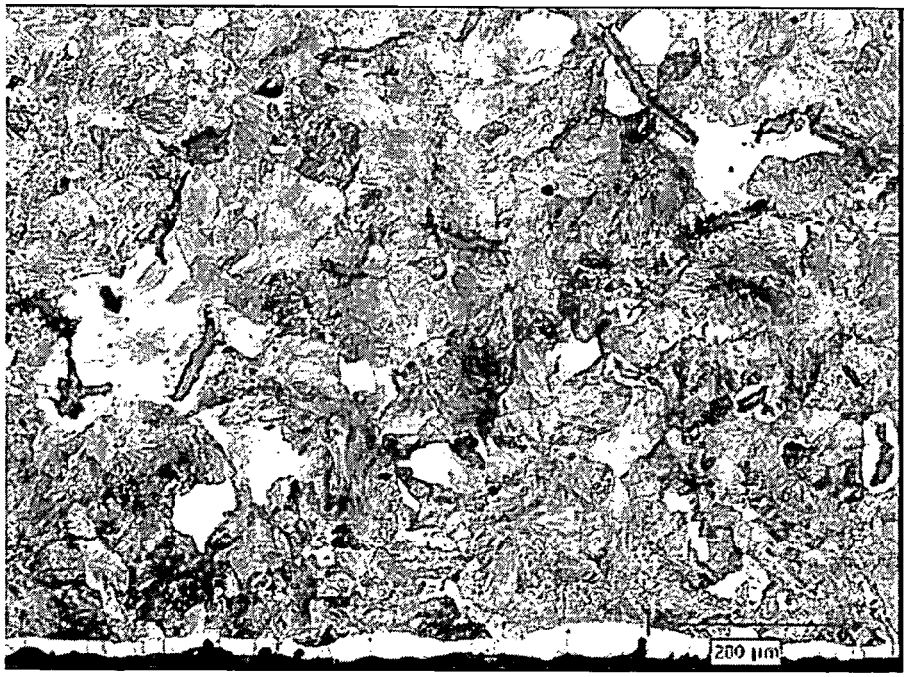
FIG. 7B is a micrograph of an infiltrated part composed of an Fe—C—Si alloy showing a degree of graphitization.

As anticipated, metallographic examinations of the specimens showed that the Degree Of Graphitization was complete in both cases. Micrograph B in FIG. 7 shows the microstructure just above the bottom surface of a specimen at the 0.75% silicon level. The structure shown in the micrograph is typical of the structure in the balance of the specimen as well as that observed in specimens at the 1.25% silicon level.

Figure 6B:
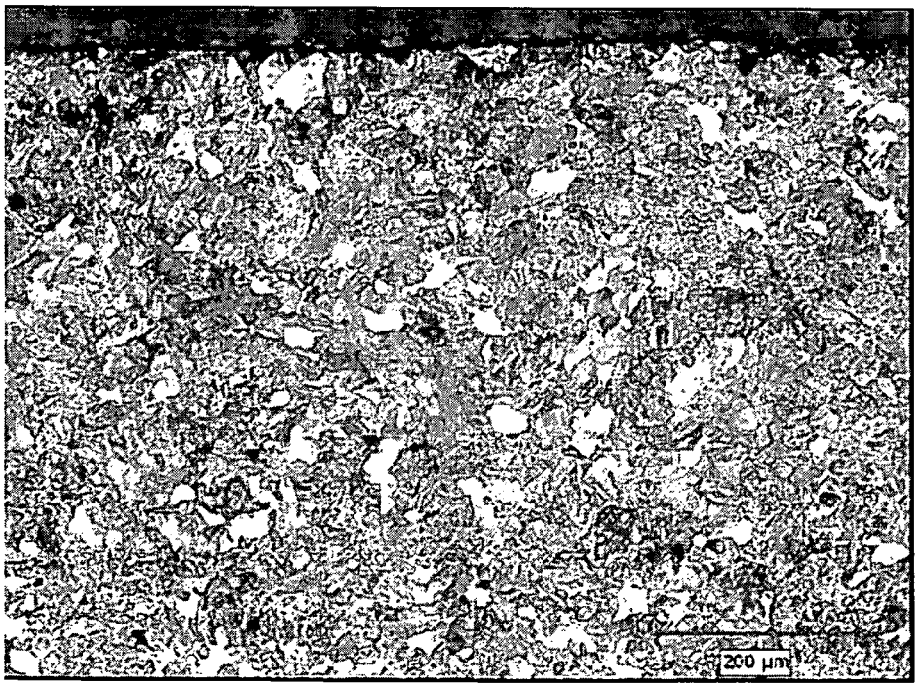
FIG. 6B is a micrograph of an infiltrated part composed of an Fe—C—Si alloy showing a degree of graphitization.

Notice that the morphology of the graphite precipitates in Micrograph B of FIG. 7 differs markedly from that of Micrograph A as well as from that of the micrographs in the earlier FIGS. 3 and 6. This difference is investigated with regard to the effects of processing in the next Example.

Example 4

This example illustrates the effects of process temperature and furnace type on the graphite morphology in infiltrated Base Compacts with silicon contents in the preferred range of the invention from 0.50 to 1.0%.

Here again, the findings in the Example are the product of two different trials. In the first trial, the silicon contents of both the Infiltrant and Base Compact compositions were the same at 0.50%. In the second trial, the silicon content of the Base Compact composition was nominally 0.80% but the Infiltrant was based on the Ancorsteel 4600 V powder and contained no admix silicon. The switch was made because the latter compositions along with the particular processing that was used in this trial are more typical of what will be used in actual practice.

Trial 1 Compositions and Conditions—

The iron base powder used in both the Infiltrant and the Base Compact mixes was Ancorsteel 1000 B with an oxygen content of 0.10%. As mentioned, the silicon content of both the Base Compact and Infiltrant compositions was 0.50%. The aim carbon content of the Base Compact composition was 1.89% which is about 0.05% below the eutectic solidus value. The aim carbon content of the Infiltrant composition was 4.22% which is about 0.05% above the eutectic value. The corresponding admix compositions were as follows:

Base Compact Mix 1: [1.89+0.75(0.10−0.02)]/(0.97)% 3032 HS Graphite, 2.75% 20% Si ferrosilicon, 0.45% Acrawax C, 0.10% Zinc Stearate, balance Ancorsteel 1000 B and binder treated with 0.25% PEG 35000.

Infiltrant Mix 1: [4.22+0.75(0.10−0.02)]/(0.99) % KS-10 Graphite, 2.75% 20% Si ferrosilicon, 0.10% Zinc Stearate, balance minus 325 mesh Ancorsteel 1000 B and binder treated with 0.35% AB II.

The Base Compact mixes were compacted into TRS bars at a green density of 6.7 g/cm$^3$ and nominally weighing 35 grams. The Infiltrant mix was compacted into slugs weighing 4.75 grams which is 0.25 grams less than the Infiltrant Weight To Full Density value indicated in the earlier Table 1. The slugs and Base Compacts were as always processed together. Three different processing schemes were employed as follows:

1) In the laboratory batch furnace at 1163° C., (2125° F.), for ½ hour at temperature.
2) In the laboratory batch furnace at 1177° C., (2150° F.), for ½ hour at temperature.
3) In the production belt furnace at 1163° C., (2125° F.), for ½ hour at temperature.

The furnace atmosphere in all three cases was synthetic DA and the specimens were processed in a graphite gettered sintering tray with a close fitting cover. The expected average carbon content of the final infiltrated specimens was 2.16%.

Trial 2 Compositions and Conditions—

The iron base powder used in the Base Compact mixes was Ancorsteel 1000 B with an oxygen content of 0.10%. As mentioned, the silicon content of the Base Compact composition was nominally 0.80% and the Infiltrant was based on the Ancorsteel 4600 V powder. The aim carbon content of the Base Compact composition was 1.91% which corresponds to the eutectic solidus value. The oxygen content of the Ancorsteel 4600 V powder of the Infiltrant was 0.11%. The aim carbon content in this case was 4.43% which is 0.15% above the eutectic value. The corresponding admix compositions were as follows:

Base Powder Mix 2: [1.91+0.75(0.10−0.02)]/(0.97) % 3032 HS Graphite, 4.125% 20% Si ferrosilicon, 0.45% Acrawax C, 0.10% Zinc Stearate, balance Ancorsteel 1000 B and binder treated with 0.25% PEG 35000.

Infiltrant Mix 2[(4.43+0.75(0.11−0.02)]/(0.97) % 3032 HS Graphite, 0.10% Zinc Stearate, balance minus 325 mesh Ancorsteel 4600 V and binder treated with 0.35% PEG 35000.

The Base Compact mixes were compacted into TRS bars at a green density of 6.7 g/cm$^3$ and nominally weighing 35 grams. The Infiltrant mix was compacted into slugs weighing 4.75 grams which is 0.25 grams less than the Infiltrant Weight To Full Density value indicated in the earlier Table 1. The slugs and Base Compacts were processed together. Two different processing schemes were employed as follows:

4) In the laboratory batch furnace at 1177° C., (2150° F.), for ½ hour at temperature.
5) In the production belt furnace at 1177° C., (2150° F.), for ½ hour at temperature.

The furnace atmosphere in all three cases was synthetic DA and the specimens were processed in a graphite gettered sintering tray with a close fitting cover. The expected average carbon content of the final infiltrated specimens was 2.18%.

Figure 8A:
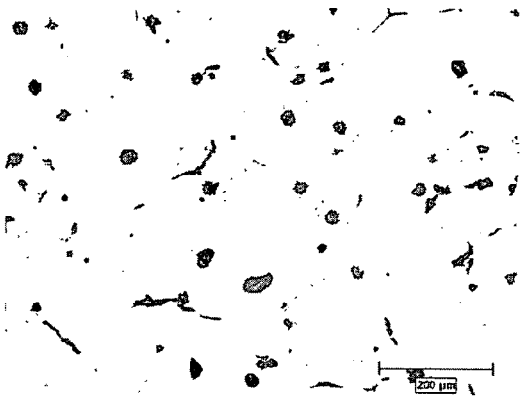
FIG. 8A is a micrograph of an infiltrated part composed of an Fe—C—Si alloy, which was infiltrated at 1163° C., (2125° F.) in a laboratory batch furnace.
Figure 8B:
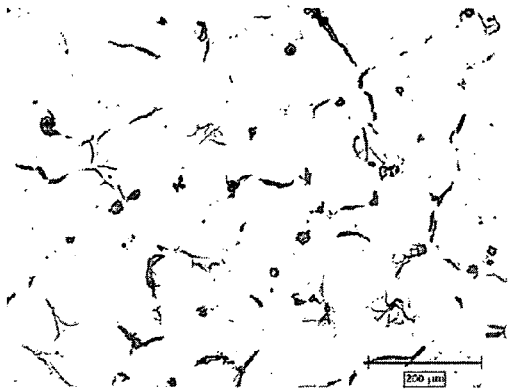
FIG. 8B is a micrograph of an infiltrated part composed of an Fe—C—Si alloy, which was infiltrated at 1177° C., (2125° F.) in a laboratory batch furnace.
Figure 8C:
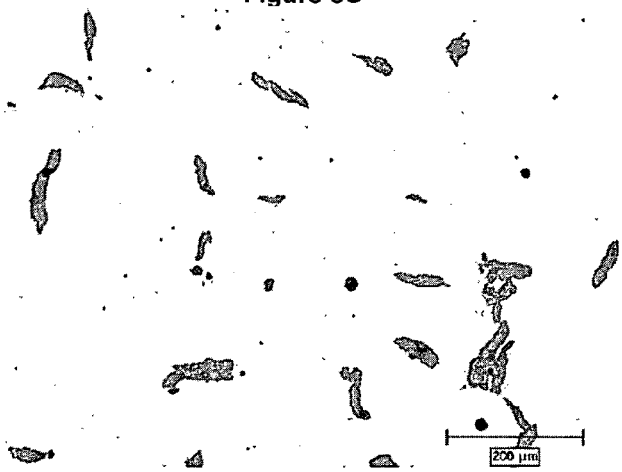
FIG. 8C is a micrograph of an infiltrated part composed of an Fe—C—Si alloy, which was infiltrated at 1163° C., (2125° F.) in a production belt furnace.

The results of the metallographic examinations of the infiltrated specimens of the first trial are presented as a series of three micrographs in FIG. 8. Micrograph A of the series shows the morphology of the graphite precipitates corresponding to processing at 1163° C., (2125° F.), in the laboratory batch furnace. The two distinct graphite morphologies that are evident in the micrograph are the nodular and compacted graphite types. The nodular type, in this case, is dominant comprising about 75% of the precipitates by volume. Micrograph B of the series shows the morphology of the graphite precipitates corresponding to processing at 1177° C., (2150° F.), also in the laboratory batch furnace. Both graphite types are again present, however, as a cursory review of the micrograph will show, the increase in temperature resulted in a virtual complete reversal of their relative proportions. The compacted type is now the dominant one and comprises about 75% of the precipitates by volume. Finally, Micrograph C of the series shows the morphology corresponding to processing again at 1163° C., (2125° F.), but in the production belt furnace.

Now, in spite of the return to the lower temperature, the compacted graphite morphology is clearly dominant comprising about 90% of the precipitates by volume. The reasons underlying this change remain to be investigated but presumably reflect the differences in the cooling characteristics of the two furnaces.

Figure 9A:
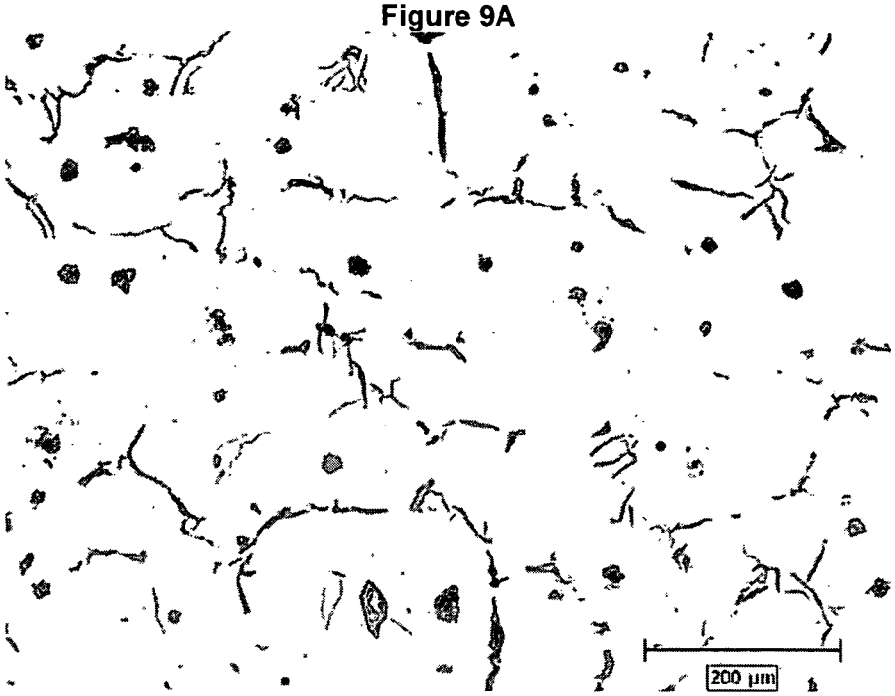
FIG. 9A is a micrograph of an infiltrated part composed of an Fe—C—Si alloy, which was infiltrated at 1177° C., (2150° F.) in a laboratory batch furnace.
Figure 9B:
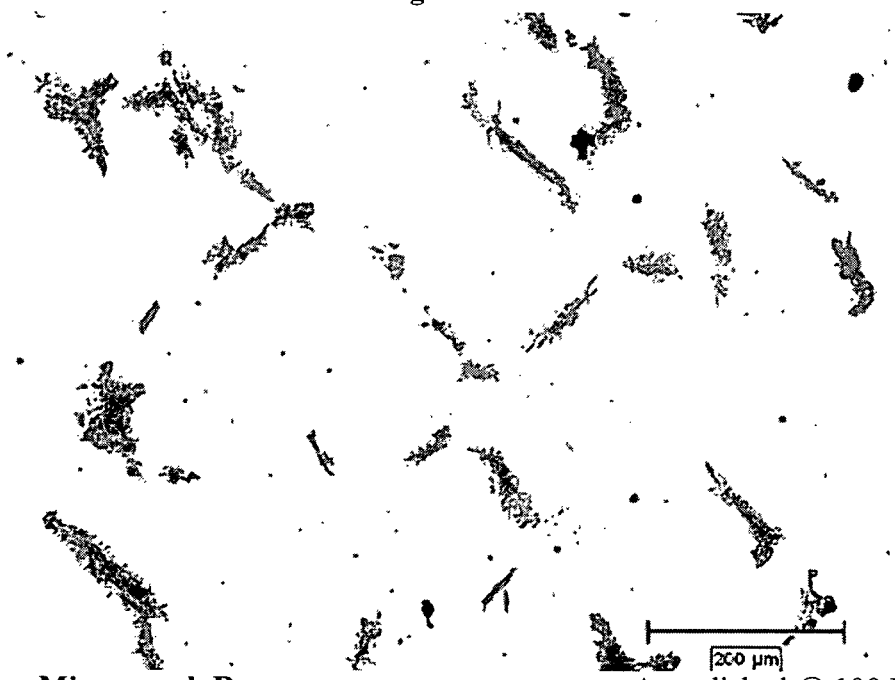
FIG. 9B is a micrograph of an infiltrated part composed of an Fe—C—Si alloy, which was infiltrated at 1177° C., (2150° F.) in a production belt furnace.

The results of the metallographic examinations of the infiltrated specimens of the second trial are presented in two micrographs in FIG. 9. Micrograph A in this case shows the morphology of the graphite precipitates corresponding to processing at 1177° C., (2150° F.), in the laboratory batch furnace. Here again, both graphite types are present but contrary to the earlier findings corresponding to this condition, (i.e. Micrograph B of FIG. 8), the compacted graphite morphology is no longer dominant. Qualitatively, the two types appear to be present in equal amounts. Presumably, this shift towards a more nodular morphology relative to the earlier findings is a result of the compositional differences between the specimens of the two trials and as with the earlier differences produced by the two furnaces, remains to be investigated. In any case, Micrograph B in this figure shows the graphite morphology corresponding to processing at the same temperature but in the production belt furnace. In this case, the results are similar to the earlier results in this furnace. Accordingly, the compacted graphite morphology is clearly dominant easily comprising upwards of 95% of the precipitates by volume.

These findings are considered to have an extremely important implication with regard to the practical embodiments of the invention particularly, in view of the very significant effects that graphite morphology is known to have on mechanical properties. According to the general trends that have so far been observed in the development of the technology and as indicated in the Example, the presence of the compacted graphite morphology increases with increase in the process temperature and is the dominant morphology in specimens that are processed in the production belt furnace regardless of the process temperature. Since high process temperatures are indicated both to optimize the density and, as shown in the following Example, to control the dimensional change of the process, its reasonable to anticipate the virtual exclusive use of high process temperatures versus low ones in practical applications. Similarly, since belt furnaces are reportedly more economic to operate and correspondingly enjoy a significantly far greater presence in the P/M industry than batch type furnaces, its likewise reasonable to anticipate their virtual exclusive use to implement the process as a practical matter. Thus, the important implication relative to the practical embodiments of the process is that the dominant graphite morphology to be expected in the resulting parts is the compacted graphite type. A further important point in this regard is that, at present, it is not known how to produce an iron base infiltrated part that has a predominantly nodular graphite morphology which is simultaneously optimum in terms of density and dimensional change values.

Example 5

This example illustrates the potential to use liquid phase sintering after infiltration to control the dimensional change of the process. The iron base powder used in both the Infiltrant and the Base Compact mixes was Ancorsteel 1000 B with an oxygen content of 0.08%. The admix silicon content was in the form of a 1.5% SiC addition and was nominally 1.05%. The aim carbon content of the Base Compact was 1.75% which is 0.11% below the eutectic solidus value at 1.86% as shown by the ternary isopleth at 1% Si in FIG. 2. The aim carbon content in the case of the Infiltrant was 4.00% which is just below the eutectic value as also shown in the figure. The corresponding admix compositions were as follows:

Base Compact Mix: [1.75+0.75(0.08−0.02)−0.3(1.5)]/(0.97) % 3203 HS Graphite, 1.5% F-600 SiC, 0.5% Acrawax C, balance Ancorsteel 1000 B and binder treated with 0.20% ABII.

Infiltrant Mix: [4.00+0.75(0.08−0.02)−0.3(1.5)]/(0.99) % KS-10 Graphite, 1.5% Grade F-600 SiC, balance minus 325 mesh Ancorsteel 1000 B and binder treated with 0.35% AB II.

The Base Compact mix was compacted into TRS bars at a green density of 6.7 g/cm$^3$ and nominally weighing 35 grams. The Infiltrant mix was compacted into slugs weighing 5.25, 4.50 and 3.75 grams each. The highest weight is 0.25 grams, (i.e. 5%), in excess of the Infiltrant Weight To Full Density value indicated in the earlier Table 1. The two lower weights are nominally consecutive 15% decrements of this value. Base Compacts and Infiltrant slugs at each weight were submitted to a two step process comprising infiltration at 1163° C., (2125° F.), for 15 minutes at temperature followed by liquid phase sintering at 1182° C., (2160° F.), for an additional 15 minutes at temperature in the laboratory batch furnace. The furnace atmosphere was synthetic DA and the specimens were processed in a graphite gettered sintering tray with a close fitting cover. The results of the trial are shown below in Table 12. The expected average carbon contents of the final infiltrated specimens decreased with the Infiltrant weight as shown in the table. Shown also in the table are the associated liquid phase contents at the higher temperature. As will be explained, in addition to the infiltration weight and the process conditions, these parameters also affected the outcome of the trial.

According to the findings in the table, the dimensional change decreased with decrease in the infiltrant weight and did so without significant adverse effect to the final density, especially at the intermediate weight. Thus, the data generally confirmed the expected greater contribution of sintering to the outcome of the processing and the resulting potential to control the dimensional change value. The slightly higher final density at the intermediate infiltrant weight and the lower density at the lowest weight are each thought to be attributable to the decrease in the total carbon which the data show accompanied the weight changes.

TABLE 12

Effects of Infiltration at 1163° C. Followed by Liquid Phase Sintering at 1182° C.

| Infiltrant Weight grams | Total Carbon % | Liquid Phase Content at 1182° C. % | Infiltrated Density grams/cm$^3$ | Dim. Chg. vs. Die % |
|---|---|---|---|---|
| 5.25 | 2.04 | 16.6 | 7.54 | 0.92 |
| 4.50 | 2.01 | 14.6 | 7.55 | 0.34 |
| 3.75 | 1.97 | 12.7 | 7.43 | 0.22 |

As to the first effect, as previously indicated, the pore free density of these alloys increases with decrease in the total carbon and, as it turns out, the slight increase in the density at the intermediate weight that is indicated here is just accounted for by the accompanying decrease in the total carbon value. In the case of the low density value at the lowest infiltrant weight, the connection to the total carbon is less direct. Evidently, the amount of sintering that occurred in this case was not sufficient to eliminate all of the residual porosity that was created by use of the low infiltrant weight. As a general matter, its known that the densification that occurs in liquid phase sintering varies directly as the liquid phase content. Thus, the low final density in this case is apparently attributable to the accompanying decrease in the liquid phase content as shown in the data.

Example 6

This example illustrates the tensile properties obtainable with the preferred Infiltrant and Base Compact compositions of the invention as well as the effects on properties of modest additions of copper, nickel, manganese and molybdenum to a preferred Base Compact composition. In all, seven Base Compact compositions were included in the study. Their respective alloy contents are listed below. The aim carbon content that is indicated in each case corresponds to the eutectic solidus value of the alloy as indicated by the Thermo-calc program.

1. 0.75% silicon with and aim carbon of 1.91%;
2. 0.75% silicon plus 1% copper with as aim carbon content of 1.87%;
3. 0.75% silicon plus 1% nickel with an aim carbon content of 1.86%;
4. 0.75% silicon plus 1% copper and 1% nickel with an aim carbon content of 1.82%;
5. 0.75% silicon plus 0.5% manganese with an aim carbon content of 1.88%;
6. 0.75% silicon plus 0.5% molybdenum with an aim carbon content of 1.79%; and,
7. 0.75% silicon plus 0.5% molybdenum and 2% copper with an aim carbon content of 1.74%.

The iron base powder used in the mixes corresponding to the first five of these compositions was Ancorsteel 1000 B with an oxygen content of 0.10%. The iron base powder used in the mixes corresponding to the last two of the compositions was Ancorsteel 50 HP with a pre-alloyed molybdenum content of 0.55%, a manganese content of 0.15% and an oxygen content of 0.10%. The specific mix compositions in each case were as follows.

Base Powder Mix 1: [1.91+0.75(0.10−0.02)]/(0.97) % 3032 HS Graphite, 3.875% 20% Si ferrosilicon, 0.45% Acrawax C, 0.10% Zinc Stearate, balance Ancorsteel 1000 B and binder treated with 0.25% PEG 35000.

Base Powder Mix 2: [1.87+0.75(0.10−0.02)]/(0.97) % 3032 HS Graphite, 3.875% 20% Si ferrosilicon, 1% Acupowder Grade 8081 copper, 0.45% Acrawax C, 0.10% Zinc Stearate, balance Ancorsteel 1000 B and binder treated with 0.25% PEG 35000.

Base Powder Mix 3: [1.86+0.75(0.10−0.02)]/(0.97) % 3032 HS Graphite, 3.875% 20% Si ferrosilicon, 1% Inco Grade 123 nickel, 0.45% Acrawax C, 0.10% Zinc Stearate, balance Ancorsteel 1000 B and binder treated with 0.25% PEG 35000.

Base Powder Mix 4: [1.82+0.75(0.10−0.02)]/(0.97) % 3032 HS Graphite, 3.875% 20% Si ferrosilicon, 1% Acupowder Grade 8081 copper, 1% Inco Grade 123 nickel, 0.45% Acrawax C, 0.10% Zinc Stearate, balance Ancorsteel 1000 B and binder treated with 0.25% PEG 35000.

Base Powder Mix 5: [1.88+0.75(0.10−0.02)]/(0.97) % 3032 HS Graphite, 3.875% 20% Si ferrosilicon, 1.2% 45% Mn as ManganeseSilicIron, 0.45% Acrawax C, 0.10% Zinc Stearate, balance Ancorsteel 1000 B and binder treated with 0.25% PEG 35000.

Base Powder Mix 6: [1.79+0.75(0.10−0.02)]/(0.97) % 3032 HS Graphite, 3.875% 20% Si ferrosilicon, 0.45% Acrawax C, 0.10% Zinc Stearate, balance Ancorsteel 50 HP and binder treated with 0.25% PEG 35000.

Base Powder Mix 7: [1.74+0.75(0.10−0.02)]/(0.97) % 3032 HS Graphite, 3.875% 20% Si ferrosilicon, 2% Acupowder Grade 8081 copper, 0.45% Acrawax C, 0.10% Zinc Stearate, balance Ancorsteel 50 HP and binder treated with 0.25% PEG 35000.

Each of the preferred Infiltrant compositions as earlier defined were employed in the study. The oxygen content of the Ancorsteel 4600 V used to make the one that is based on this powder was 0.11%. The aim carbon content in this case was 4.43% which is 0.15% above the eutectic value. The same Ancorsteel 1000 B powder as used in the Base Compact mixes was used to make the other one. The aim carbon content in this case 4.44% which is also 0.15% above the eutectic value. The specific mix compositions in each case were as follows. Note the Infiltrant designations that are used.

Ast 4600 V Infiltrant: [(4.43+0.75(0.11−0.02)]/(0.97) % 3032 HS Graphite, 0.10% Zinc Stearate, balance minus 325 mesh Ancorsteel 4600 V and binder treated with 0.35% PEG 35000.

Ast 1000 B Infiltrant: [(4.44+0.75(0.10−0.02)]/(0.97) % 3032 HS Graphite, 0.9% 20% Si ferrosilicon, 0.10% Zinc Stearate, balance minus 325 mesh Ancorsteel 1000 B and binder treated with 0.35% PEG 35000.

The Base Compact mixes were compacted into standard dog-bone tensile specimens at a green density of 6.7 g/cm$^3$ and nominally weighing 25 grams. The Infiltrant mixes were compacted in the same die to slugs weighing 3.75 grams which is 0.15 grams, (i.e. 5%), greater than the Infiltrant Weight To Full Density value indicated in the earlier Table 1. The Base Compacts and slugs were processed together at 1182° C., (2160° F.), in the production belt furnace at a belt speed of 30.5 centimeters per minute, (1.2 inches per minute), corresponding to a time at temperature of about 40 minutes. The furnace atmosphere in this trial was nominally 90% $N_2$ and 10% $H_2$ by volume and was otherwise treated with 0.25% methane by volume to increase its carbon potential. In addition, the specimens were processed in the open without benefit of the covered and graphite gettered sintering trays that were used in the earlier Examples. The as-infiltrated results of the trial are presented in Tables 13 and 14. The tensile property and hardness values in the table represent the average of at least three determinations per composition. The density values are based on water immersion determinations on a single specimen per composition.

A review of the data in these two tables will show that there were three instances in which the properties of the compositions that were infiltrated with the Ast 4600 V Infiltrant were better than those of the comparable compositions infiltrated with the Ast 1000 B; one in which the properties were about equal; and, three in which they were not as good. Thus, the general indication of the findings was that the two Infiltrant compositions are about equal to each other in terms of their effects on mechanical properties.

TABLE 13

Mechanical Properties of Various Ast 4600 V Infiltrated Compositions

| Base Compact ID By Admixed Alloy | Density g/cm$^3$ | Tensile Strength MPa | Tensile Strength (ksi) | Yield Strength MPa | Yield Strength (ksi) | Elongation % in 2.5 cm | Hardness $R_A$ |
|---|---|---|---|---|---|---|---|
| 0.75% Si Base | 7.47 | 508 | (73.7) | 365 | (52.9) | 1.9 | 57 |
| +1% Cu | 7.48 | 606 | (87.8) | 403 | (58.5) | 2.4 | 61 |
| +1% Ni | 7.47 | 543 | (78.7) | 386 | (56.0) | 1.7 | 58 |
| + 1% Cu + 1% Ni | 7.34 | 659 | (95.5) | 474 | (68.7) | 2.1 | 63 |
| +0.5% Mn | 7.24 | 543 | (78.7) | 414 | (60.0) | 1.4 | 56 |
| +0.5% Mo | 7.52 | 616 | (89.3) | 432 | (62.7) | 2.0 | 59 |
| + 0.5% Mo + 2% Cu | 7.52 | 723 | (104.8) | 583 | (84.5) | 1.3 | 66 |

TABLE 14

Mechanical Properties of Various Ast 1000 B Infiltrated Compositions

| Base Compact ID By Admixed Alloy | Density g/cm$^3$ | Tensile Strength MPa | Tensile Strength (ksi) | Yield Strength MPa | Yield Strength (ksi) | Elongation % in 2.5 cm | Hardness $R_A$ |
|---|---|---|---|---|---|---|---|
| 0.75% Si Base | 7.47 | 484 | (70.2) | 357 | (51.7) | 1.6 | 56 |
| +1% Cu | 7.43 | 597 | (86.6) | 422 | (61.2) | 2.2 | 60 |
| +1% Ni | 7.46 | 504 | (73.1) | 377 | (54.6) | 1.5 | 55 |
| + 1% Cu + 1% Ni | 7.25 | 583 | (84.5) | 431 | (62.5) | 1.8 | 60 |
| +0.5% Mn | 7.34 | 516 | (74.8) | 385 | (55.8) | 1.5 | 57 |
| +0.5% Mo | 7.53 | 689 | (99.9) | 575 | (83.4) | 1.3 | 66 |
| + 0.5% Mo + 2% Cu | 7.53 | 699 | (101.3) | 485 | (70.3) | 1.2 | 68 |

In other respects, it was evident that all of the alloy additions had beneficial effects in increasing the mechanical properties relative to the 0.75% Si Base composition. The copper and molybdenum additions effected the largest improvements. In comparison, the nickel and manganese additions were associated with more modest improvements of about the same magnitude. In addition, it was evident from the low infiltrated densities, especially in the case of the manganese, that additional study would be needed to optimize their effects.

Comparison of these findings with the properties of the Compacted Graphite and Ductile cast irons as indicated in the earlier Tables 4 and 5 is of interest. Recall that at the present Base Compact silicon content of 0.75%, the microstructure in the as-infiltrated condition consists essentially of graphite precipitates in a pearlitic matrix and that the graphite morphology in the case of specimens processed in the production belt furnace is predominantly of the compacted type. Thus, the present findings are directly comparable with the properties of the Compacted Graphite cast irons in the normalized condition, (i.e. ~90% pearlitic), and less directly, with the properties of the Ductile cast irons in the as-cast condition.

The lowest properties in each of the present data sets are those of the 0.75% Si Base. Significantly, the results in both cases are generally superior to the properties that are listed in Table 4 for the un-alloyed Compacted Graphite cast irons in all conditions of treatment and rival those of the nickel containing version in the normalized condition. On the other hand, the present properties are generally not as good as those of the Ductile cast irons as listed in Table 5. Although the strength and hardness values in the present data are comparable in some cases, the ductility values are clearly inferior in just about every case. Thus, the general indication of the present findings is that in its current stage of development the iron base infiltration process is capable of producing parts with properties that are roughly midway between those typical of the Compact Graphite and Ductile cast irons.

Example 7

This example illustrates the effects of sintering in advance of infiltration on the dimensional uniformity of the resulting parts. Two cases are presented. In one case, the effects on sintering of the significantly lower heating rate characteristic of the production belt furnace versus that of the batch type furnace are shown. In the other case, the effects of using a separate pre-sintering step are shown.

Case 1 Compositions and Conditions—

The iron base powder used in the Base Compact mix was Ancorsteel 1000 B with an oxygen content of 0.10%. The silicon content of the Base Compact composition was nominally 1%. About half of the silicon in this case was added as the 20% Si ferrosilicon alloy and the remainder as SiC. The aim carbon content of the Base Compact composition was 1.86% which corresponds to the eutectic solidus value. The Infiltrant was based on the Ancorsteel 4600 V powder. The oxygen content of the powder used in the mix was 0.11%. The aim carbon content in this case was 4.43% which is 0.15% above the eutectic value. The corresponding admix compositions were as follows:

Base Powder Mix 1: [1.86+0.75(0.10−0.02)−0.3(0.71)]/(0.97)% 3032 HS Graphite, 2.75% 20% Si ferrosilicon, 0.71% Grade F-600 SiC, 0.45% Acrawax C, 0.10% Zinc Stearate, balance Ancorsteel 1000 B and binder treated with 0.25% PEG 35000.

Infiltrant Mix 1: [(4.43+0.75(0.11−0.02)]/(0.97) % 3032 HS Graphite, 0.10% Zinc Stearate, balance minus 325 mesh Ancorsteel 4600 V and binder treated with 0.35% PEG 35000.

The Base Compact mixes were compacted into TRS bars at a green density of 6.7 g/cm$^3$ and nominally weighing 35 grams. The Infiltrant mix was compacted into slugs weighing 4.75 grams which is 0.25 grams less than the Infiltrant Weight To Full Density value indicated in the earlier Table 1. The slugs and Base Compacts were processed together in one case, in the laboratory batch furnace and in the other, in the production belt furnace. In each case, the process temperature was 1177° C., (2150° F.), the time was nominally ½ hour at temperature, the furnace atmosphere was synthetic DA and the specimens were processed in a graphite gettered sintering tray with a close fitting cover. The expected average carbon content of the final infiltrated specimens was 2.15%.

Case 2 Compositions and Conditions—

The iron base powder used in the both the Infiltrant and Base Compact mixes was Ancorsteel 1000 B with an oxygen content of 0.086%. The silicon content of the Base Compact composition was nominally 1% and the silicon was added as SiC. The aim carbon content of the Base Compact composition was 1.86% which corresponds to the eutectic solidus value. The silicon content of the Infiltrant was likewise nominally 1% and the silicon was added as the 20% Si ferrosilicon alloy. The aim carbon content in this case was 4.06% which is 0.05% above the eutectic value. The corresponding admix compositions were as follows:

Base Powder Mix 2: [1.89+0.75(0.086−0.02)−0.31.5)]/(0.975)% 3032 HS Graphite, 1.5% Grade F-600 SiC, 0.55% Acrawax C, 0.075% Zinc Stearate, balance Ancorsteel 1000 B and binder treated with 0.20% ABII.

Infiltrant Mix 2: [(4.06+0.75(0.086−0.02)]/(0.99) % KS-10 Graphite, 5.5% 20% Si ferrosilicon, 0.05% Zinc Stearate, balance minus 325 mesh Ancorsteel 1000 B and binder treated with 0.35% ABII.

The Base Compact mixes were compacted into TRS bars at a green density of 6.7 g/cm$^3$ and nominally weighing 35 grams. The Base Compacts were pre-sintered in the laboratory batch furnace at 1146° C., (2095° F.), for 1 hour at temperature. The average density and weight after sintering were 6.57 g/cm$^3$ and 34.6 grams. The Infiltrant mix was compacted into slugs weighing 5.5 grams which is 0.21 grams less than the Infiltrant Weight To Full Density value indicated in the earlier Table 1. The slugs and pre-sintered Base Compacts were now processed together at 1177° C., (2150° F.), for ½ hour at temperature in the laboratory batch furnace. The furnace atmosphere was synthetic DA and the specimens were processed in a graphite gettered sintering tray with a close fitting cover. The expected average carbon content of the final infiltrated specimens was 2.19%.

The results of the study of the effects of the differences in the heating rates of the laboratory batch and the production belt furnaces are shown below in Table 15.

A cursory review of the data in the table will show that the resulting densities and dimensional change values in each case were reasonably comparable but that the distortion values of the specimens that were processed in the production belt furnace were significantly lower than those of the ones that were processed in the batch furnace. As previously explained, the heating rate of the furnace is important because it determines the sintering time and hence the strength of the sinter bonds that form in advance of infiltration and ultimately, their resistance to liquid penetration and separation during the infiltration step or, in effect, to the distortion that the latter changes would otherwise produce.

TABLE 15

Heating Rate Effects on Dimensional Uniformity

| Specimen Number | Density g/cm$^3$ | Dim. Chg. vs. Die % | Distortion Mm | Distortion (inches) |
|---|---|---|---|---|
| Laboratory Batch Furnace | | | | |
| 1 | 7.37 | 0.96 | 0.237 | (0.0092) |
| 2 | 7.37 | 0.95 | 0.244 | (0.0096) |
| Average | 7.37 | 0.96 | 0.239 | (0.0094) |
| Production Belt Furnace | | | | |
| 1 | 7.36 | 0.73 | 0.089 | (0.0035) |
| 2 | 7.37 | 0.76 | 0.058 | (0.0023) |
| Average | 7.37 | 0.75 | 0.074 | (0.0029) |

In the case of the laboratory batch furnace, the average heating rate is of the order of 55° C. per minute, (100° F. per minute). Thus, given that significant sinter bond formation does not start until lubricant burn-off is complete at about 600° C., (~1100° F.), the total sintering time in advance of infiltration in the batch furnace was only about 10 minutes. In comparison, the situation in the production belt furnace was quite different. To start, the furnace is equipped with a lubricant burn-off zone that is typically set somewhat higher than 600° C. at 740° C., (1360° F.). Based on the belt speed that was used in the study, (i.e. 30.5 centimeters per minute), the time at temperature in this zone was upwards of 30 minutes. Then, in addition, the heating rate thereafter was comparatively slow at about 15° C. per minute, (27° F. per minute). Thus, the heating time beyond the lubricant burn-off zone and in advance of infiltration in this case was of the order of 2.5 to 3 times longer than in the batch furnace. Moreover, considering the long hold time in the burn-off zone as well, the actual sintering may have been as much as 3.5 to 4 times greater.

The results of the study of the effects of using a separate pre-sintering step on the dimensional uniformity are shown in Table 16.

Recall that the infiltration step in this case was done in the laboratory batch furnace under essentially the same process conditions as earlier but that the infiltrant weight and both the Infiltrant and Base Compact compositions were different than earlier. Thus, while the comparison between the present results and the earlier ones is clearly indicative of the effects of the pre-sintering step, it is nevertheless somewhat indirect.

TABLE 15

Heating Rate Effects on Dimensional Uniformity

| Specimen Number | Density g/cm³ | Dim. Chg. vs. Die % | Distortion Mm | Distortion (inches) |
|---|---|---|---|---|
| 1 | 7.45 | 1.48 | 0.066 | (0.0026) |
| 2 | 7.46 | 1.48 | 0.064 | (0.0025) |
| 3 | 7.46 | 1.46 | 0.056 | (0.0022) |
| Average | 7.46 | 1.47 | 0.061 | (0.0024) |

A review of the data in this table will show that both the densities and dimensional change values that are indicated are generally higher than earlier but that the distortion values, especially as compared to those of the specimens that were processed in the laboratory batch furnace, are appreciably lower. The relatively higher density and dimensional change values in the present case are due primarily to the density decrease that occurred in the pre-sintering step and the decision to use a higher infiltrant weight to compensate for the decrease. The alternative to using the higher infiltrant weight was to use the same weight. However, in view of the fact that the process temperature used in the studies was not particularly conducive to liquid phase sintering after infiltration, it's likely that the density would have been about the same as earlier but that the dimensional change would still be substantially higher although perhaps not quite as high as at present. The relatively lower distortion values in the present case are also attributable to the pre-sintering step and basically demonstrate the efficacy of this processing to favorably effect the dimensional uniformity property. Of course, as mentioned, the comparison is not direct because of the different infiltrant weight and compositions that were used. In fact, however, it's very likely that if the same weight and compositions as earlier had been used, the distortion values would have been even lower. More particularly, numerous studies have shown that the distortion value typically increases with increase in the infiltrant weight and especially, with increase in the silicon content of the Infiltrant. Thus, the higher infiltrant weight and silicon content of the Infiltrant in the present case were, in effect, a more severe test of the idea to use a pre-sintering step to decrease the distortion value.

What is claimed is:

1. A method of making powder metallurgy parts using iron-based infiltration comprising the steps of:

a. providing an infiltrant, the infiltrant comprising a first iron-based alloy system comprising a first iron-based powder admixed with a first binder, wherein the first iron-based alloy system is in the form of a binder-treated admixture that is a near eutectic liquidus composition or a eutectic liquidus composition;

b. providing a base compact having a density prior to infiltration of from about 5.57 to about 6.8 g/cm3, the base compact having been prepared by uniaxial compaction of a second iron-based alloy system comprising a second iron-based powder, the second iron-based powder having been manufactured by water atomization, admixed with a second binder, wherein the second iron-based alloy system is in the form of a binder treated admixture that is near eutectic solidus powder composition or a eutectic solidus powder composition;

c. contacting the base compact with the infiltrant;

d. heating the infiltrant and base compact to a process temperature above the eutectic temperature of the infiltrant, thereby forming a liquid component of the infiltrant; and e. maintaining the process temperature above the eutectic temperature of the infiltrant for a period of time sufficient to permit the infiltrant to infiltrate the base compact.

2. The method of making powder metal parts according to claim 1, wherein the infiltrant is a uniaxially compacted iron-based alloy system in the form of a binder treated admixture.

3. The method of making powder metal parts according to claim 1, wherein the first and second alloy systems each include:

a. as a major component, iron, and b. as a minor component, carbon, silicon, nickel, copper, molybdenum, manganese, or combinations thereof.

4. The method of making powder metal parts according to claim 1, wherein the infiltrant, prior to infiltration, contains from 4.24 to 4.64 weight percent carbon and the base compact, prior to infiltration, comprises from about 1.75 to about 2.15 weight percent carbon.

5. The method of making powder metal parts according to claim 1, wherein each of the first and second alloy systems contain carbon and silicon.

6. The method of making powder metal parts according to claim 5, wherein each of the first and second alloy systems includes from about 0.01 to about 2.0 weight percent silicon.

7. The method of making powder metal parts according to claim 5, wherein each of the first and second alloy systems includes from about 0.25 to about 1.25 weight percent silicon.

8. The method of making powder metal parts according to claim 5, wherein each of the first and second alloy systems includes from about 0.5 to about 1.0 weight percent silicon.

9. The method of making powder metal parts according to claim 5, wherein each of the first and second alloy systems includes from about 0.70 to about 0.80 weight percent silicon.

10. The method of making powder metal parts according to claim 5, wherein the weight percent of carbon in the infiltrant is in the range of from (4.24−0.33X) to (4.64−0.33X), wherein X is the weight percent of silicon in the infiltrant.

11. The method of making powder metal parts according to claim 6, wherein the weight percent of carbon in the base compact is in the range of from (1.75−0.17Y) to (2.15−0.17Y), wherein Y is the weight percent of silicon in the base compact.

12. The method of making powder metal parts according to claim 1, wherein the infiltrant, prior to infiltration, comprises from about 4.34 to about 4.59 weight percent carbon and the base compact, prior to infiltration, comprises from about 1.75 to about 2.03 weight percent carbon.

13. The method of making powder metal parts according to claim 1, wherein the first alloy system is different from the second alloy system.

14. The method of making powder metal parts according to claim 1, further comprising the step of sintering the base compact after the infiltrating step.

15. The method of making powder metal parts according to claim 1, further comprising the step of sintering the base compact before the infiltrating step.

16. The method of making powder metal parts according to claim 1, said step of infiltrating said base compact with said liquid infiltrant comprising substantially filling the pores of the base compact with the liquid infiltrant.

17. The method of making powder metal parts according to claim 1, wherein the infiltrant and the base compact further comprise zinc stearate.

18. The method of making powder metal parts according to claim 17, wherein the infiltrant further comprises about 0.1%, by weight of the infiltrant, of zinc stearate.

19. The method of making powder metal parts according to claim 17 or 18, wherein the base compact comprises about 0.1%, by weight of the base compact, of zinc stearate.

20. The method of making powder metal parts according to claim 1, wherein the base compact further comprises from about 0.01% to about 4.0%, by weight of the base compact, of copper.

21. The method of making powder metal parts according to claim 20, wherein the base compact comprises from about 0.5% to about 2.0%, by weight of the base compact, of copper.

22. The method of making powder metal parts according to claim 20, wherein the base compact comprises about 1.0%, by weight of the base compact, of copper.

23. The method of making powder metal parts according to claim 20, wherein the base compact comprises about 2.0%, by weight of the base compact, of copper.

24. The method of making powder metal parts according to claim 1, wherein the base compact further comprises from about 0.01% to about 4.0%, by weight of the base compact, of nickel.

25. The method of making powder metal parts according to claim 24, wherein the base compact comprises from about 0.51% to about 2.0%, by weight of the base compact, of nickel.

26. The method of making powder metal parts according to claim 24, wherein the base compact comprises about 1.0%, by weight of the base compact, of nickel.

27. The method of making powder metal parts according to claim 1, wherein the maximum liquid phase content after infiltration is about 25%, by weight of the metal part.

28. The method of making powder metal parts according to claim 1, wherein the base compact further comprises molybdenum.

29. The method of making powder metal parts according to claim 28, wherein the base compact comprises about 0.5% molybdenum.

30. The method of making powder metal parts according to claim 1, wherein the density of the base compact is about 90% to about 84% of the theoretical maximum density of the base compact.

31. The method of making powder metal parts according to claim 1, wherein the density of the metal part is from about 7.24 g/cm3 to about 7.63 g/cm3.

32. The method of making powder metallurgy parts according to claim 1, wherein the base compact directly contacts the infiltrant.

33. The method of making powder metal parts according to claim 5, wherein each of the first and second alloy systems includes from about 0.15 to about 0.25 weight percent silicon.

34. The method of making powder metal parts according to claim 1, wherein the first alloy system includes from about 0.01 to about 1 weight percent silicon.

35. The method of making powder metal parts according to claim 1, wherein the first alloy system includes from about 0.01 to about 0.5 weight percent silicon.

36. The method of making powder metal parts according to claim 1, wherein the first alloy system includes from about 0.15 to about 0.25 weight percent silicon.

37. A method of making powder metallurgy parts using iron-based infiltration comprising the steps of:

a. providing an infiltrant, the infiltrant comprising a first iron-based alloy system comprising a first iron-based powder admixed with a first binder, carbon and silicon, and in the form of a binder-treated admixture comprising carbon and silicon and being a near eutectic liquidus composition or a eutectic liquidus composition;

b. providing a base compact having a density prior to infiltration of from about 5.57 to about 6.8 g/cm3, the base compact having been prepared by uniaxial compaction of a second iron-based alloy system comprising a second iron-based powder, the second iron-based powder having been manufactured by water atomization, admixed with a second binder, carbon and silicon and in the form of a binder-treated admixture comprising carbon and silicon and being a near eutectic solidus powder composition or a eutectic solidus powder composition;

c. contacting the base compact with the infiltrant;

d. heating the infiltrant and base compact to a process temperature above the eutectic temperature of the infiltrant, thereby forming a liquid component of the infiltrant; and e. maintaining the process temperature above the eutectic temperature of the infiltrant for a period of time sufficient to permit the infiltrant to infiltrate the base compact.

38. The method of claim 37, wherein the infiltrant comprises from about 4.24 to about 4.64 percent, by weight of the infiltrant, of carbon and about 0.01 to about 2.0 percent, by weight of the infiltrant, of silicon and wherein the base compact comprises from about 1.75 to about 2.15 percent, by weight of the base compact, of carbon and about 0.01 to about 2.0 percent, by weight of the base compact, of silicon.

39. The method of claim 37, wherein the infiltrant comprises from about 4.24 to about 4.64 percent, by weight of the infiltrant, of carbon and about 0.15 to about 0.25 percent, by weight of the infiltrant, of silicon and wherein the base compact comprises from about 1.75 to about 2.15 percent, by weight of the base compact, of carbon and about 0.15 to about 0.25 percent, by weight of the base compact, of silicon.

40. The method of claim 37, wherein the base compact further comprises from about 0.01 to about 4.0 percent, by weight of the base compact, of copper.

41. The method of claim 37 or 40, wherein the base compact comprises from about 0.01 to about 4.0 percent, by weight of the base compact, of nickel.

42. The method of claim 37, wherein the infiltrant and the base compact further comprise zinc stearate.

43. The method of claim 42, wherein the infiltrant comprises 0.1%, by weight of the infiltrant, of zinc stearate and the base compact comprises 0.1%, by weight of the base compact, of zinc stearate.

44. A method of making powder metallurgy parts using iron-based infiltration comprising the steps of:

a. providing an iron-based infiltrant comprising a composition of a first iron based alloy system, said infiltrant, prior to infiltration, comprising from 4.24 to 4.64 weight percent carbon;

b. providing an iron-based base compact comprising a powder composition of a second iron-based alloy system, said base compact, prior to infiltration, comprising from 1.75 to 2.15 weight percent carbon;

c. contacting the base compact with the infiltrant;

d. heating the infiltrant and base compact to a process temperature above the melting point of the infiltrant, thereby forming a liquid component of the infiltrant; and e. infiltrating the base compact with the liquid component of the infiltrant;

wherein each of the first and second alloy systems are Fe—C systems or Fe—C—Si systems.

45. The method of claim 44, wherein the iron-based infiltrant is a compacted iron-based powder mixture comprising a composition of a first iron-based alloy system, and the iron-based base compact is a porous metal skeleton prepared by compacting an iron-based powder mixture comprising a composition of a second iron-based alloy system.

46. The method of claim 44, wherein the first and second alloy systems each include, as a major component, iron; and as a minor component, silicon, nickel, copper, molybdenum, manganese, or combinations thereof.

47. The method of claim 44, wherein each of the first and second alloy systems are Fe—C—Si systems and include from 0.01 to 2.0 weight percent silicon.

48. The method of claim 44, wherein each of the first and second alloy systems are Fe—C—Si systems and include from 0.25 to 1.25 weight percent silicon.

49. The method of claim 44, wherein each of the first and second alloy systems are Fe—C—Si systems and include from 0.5 to 1.0 weight percent silicon.

50. The method of claim 44, wherein each of the first and second alloy systems are Fe—C—Si systems and include from 0.7 to 0.8 weight percent silicon.

51. The method of claim 44, wherein the first alloy system is different from the second alloy system.

52. The method of claim 44, further comprising the step of sintering the base compact after the infiltrating step.

53. The method of claim 44, further comprising the step of sintering the base compact before the infiltrating step.

54. The method of claim 44, further comprising a controlled cooling step after the infiltration step.

55. The method of claim 44, wherein infiltration of the base compact is driven by capillary forces.

56. The method of claim 44, wherein said step of infiltrating porosities of said base compact with said melted infiltrant comprises substantially filling a network of interconnected porosities with said melted infiltrant.

57. The method of claim 44, wherein said step of infiltrating porosities of said base compact with said melted infiltrant comprises filling a portion of a network of interconnected porosities with said melted infiltrant.

* * * * *